US010100467B2

(12) United States Patent
Gane et al.

(10) Patent No.: US 10,100,467 B2
(45) **Date of Patent: *Oct. 16, 2018**

(54) PROCESS FOR THE MANUFACTURE OF STRUCTURED MATERIALS USING NANO-FIBRILLAR CELLULOSE GELS

(75) Inventors: Patrick A.C. Gane, Rothrist (CH); Michel Schenker, Schönenwerd (CH); Ramjee Subramanian, Espoo (FI); Joachim Scholkopf, Killwangen (CH)

(73) Assignee: FiberLean Technologies Limited, Par, Cornwall (GB)

( * ) Notice: Subject to any disclaimer, the term of this patent is extended or adjusted under 35 U.S.C. 154(b) by 0 days.

This patent is subject to a terminal disclaimer.

(21) Appl. No.: 13/640,533

(22) PCT Filed: Apr. 26, 2011

(86) PCT No.: PCT/EP2011/056542

§ 371 (c)(1),
(2), (4) Date: Jan. 16, 2013

(87) PCT Pub. No.: WO2011/134939

PCT Pub. Date: Nov. 3, 2011

(65) Prior Publication Data

US 2013/0126112 A1 May 23, 2013

Related U.S. Application Data

(60) Provisional application No. 61/343,775, filed on May 4, 2010.

(30) Foreign Application Priority Data

Apr. 27, 2010 (EP) ..... 10161166

(51) Int. Cl.
*D21H 11/18* (2006.01)
*D21H 17/67* (2006.01)
*D21C 9/00* (2006.01)

(52) U.S. Cl.
CPC ..... *D21H 11/18* (2013.01); *D21C 9/007* (2013.01); *D21H 17/675* (2013.01)

(58) Field of Classification Search
CPC ..... D21H 9/007; D21H 11/16; D21H 11/17; D21H 17/675; D21H 17/67; D21H 17/63; D21H 17/68; D21B 1/00; D21B 1/04; D21B 1/12; D21B 1/14; D21B 1/18; D21B 1/30; B82Y 30/00; C08J 3/00; C08J 3/075; C08J 5/005; D01D 5/423; D01F 2/00; D21C 9/004; D21C 9/007
USPC ..... 162/9, 70, 91, 141–149, 158, 162/181.1–181.8, 183, 187; 241/14–16, 241/21; 977/773, 787, 788, 900, 902, 977/961, 963
See application file for complete search history.

(56) References Cited

U.S. PATENT DOCUMENTS

| | | | | |
|---|---|---|---|---|
| 57,307 | A | | 8/1866 | Fletcher |
| 168,783 | A | | 10/1875 | Riley |
| 2,006,209 | A | | 5/1933 | Bradner |
| 2,169,473 | A | | 2/1935 | Olsen et al. |
| 2,583,548 | A | | 3/1948 | Lutton et al. |
| 3,075,710 | A | | 1/1963 | Feld et al. |
| 3,730,830 | A | * | 5/1973 | Driscoll ..... 162/146 |
| 3,765,921 | A | | 10/1973 | Puskar |
| 3,794,558 | A | * | 2/1974 | Back ..... 162/175 |
| 3,820,548 | A | | 6/1974 | Buchmann et al. |
| 3,921,581 | A | | 11/1975 | Brewer |
| 4,026,762 | A | | 5/1977 | Bauman |
| 4,087,317 | A | | 5/1978 | Roberts |
| 4,167,548 | A | | 9/1979 | Arduini et al. |
| 4,229,250 | A | | 10/1980 | Lehtinen |
| 4,275,084 | A | | 6/1981 | Ohyabu et al. |
| 4,285,842 | A | | 8/1981 | Herr |
| 4,318,959 | A | | 3/1982 | Evans et al. |
| 4,341,807 | A | | 7/1982 | Turbak et al. |
| 4,356,060 | A | | 10/1982 | Neckermann et al. |
| 4,374,702 | A | * | 2/1983 | Turbak et al. ..... 162/100 |
| 4,378,381 | A | | 3/1983 | Turbak et al. |
| 4,426,258 | A | | 1/1984 | Browning |
| 4,452,721 | A | | 6/1984 | Turbak et al. |
| 4,452,722 | A | | 6/1984 | Turbak et al. |
| 4,460,737 | A | | 8/1984 | Evans et al. |

(Continued)

FOREIGN PATENT DOCUMENTS

| | | |
|---|---|---|
| BE | 1006908 A3 | 1/1995 |
| CA | 1096676 | 3/1981 |

(Continued)

OTHER PUBLICATIONS

Shen et al., "Carbohydrate-based fillers and pigments for papermaking: A Review," 2011, Carbohydrate Polymers, Vo. 85, pp. 17-22.*
Chauhan et al., "Use of Nanotechnology for High Performance Cellulosic and Papermaking Products," 2012, Cellulose Chemistry and Technology, 46 (5-6), pp. 389-400.*
Charrani et al., "Rheological characterization of high concentrated MFC gel from kenaf unbleached pulp," 2013, Cellulose, vol. 20, pp. 727-740.*
Opietnik et al., "Tencel® Gel—A novel Cellulose Micro Suspension," 2013, Lenzinger Berichte, vol. 91, pp. 89-92.*

(Continued)

*Primary Examiner* — Jose A Fortuna
(74) *Attorney, Agent, or Firm* — Pierce Atwood LLP; Raymond G. Arner

(57) ABSTRACT

A process for manufacturing structured material by providing cellulose fibers and at least one filler and/or pigment, combining the cellulose fibers and the at least one filler and/or pigment, fibrillating the cellulose fibers in the presence of the at least one filler and/or pigment until a gel is formed, subsequently providing additional non-fibrillated fibers, and combining the gel with the additional non-fibrillated fibers.

26 Claims, 14 Drawing Sheets

(56) References Cited

U.S. PATENT DOCUMENTS 4,464,287 A 8/1984 Turbak et al.
4,474,949 A 10/1984 Chatterjee et al.
4,481,076 A * 11/1984 Herrick ..... 162/158
4,481,077 A * 11/1984 Herrick ..... 162/158
4,487,634 A 12/1984 Turbak et al.
4,495,245 A 1/1985 Zunker
4,500,546 A 2/1985 Turbak et al.
4,510,020 A 4/1985 Green et al.
4,705,712 A 11/1987 Cashaw et al.
4,744,987 A 5/1988 Mehra et al.
4,761,203 A 8/1988 Vinson
4,820,813 A 4/1989 Schulz
4,889,594 A 12/1989 Gavelin
4,952,278 A * 8/1990 Gregory et al. ..... 162/141
5,009,886 A 4/1991 Ahmad et al.
5,098,520 A 3/1992 Begala
5,104,411 A 4/1992 Makoui et al.
5,123,962 A 6/1992 Komuro et al.
5,156,719 A 10/1992 Passaretti
5,223,090 A 6/1993 Klungness et al.
5,227,024 A 6/1993 Gomez
5,225,041 A 7/1993 Richard et al.
5,228,900 A 7/1993 Stephens et al.
5,240,561 A 8/1993 Kaliski
5,244,542 A 9/1993 Bown et al.
5,269,470 A 12/1993 Ishikawa et al.
5,274,199 A 12/1993 Uryu et al.
5,279,663 A 1/1994 Kaliski
5,312,484 A 1/1994 Kaliski
5,290,830 A 3/1994 Tung et al.
5,316,621 A 5/1994 Kitao et al.
5,385,640 A 1/1995 Weibel et al.
5,443,902 A 1/1995 Knox et al.
5,387,319 A 2/1995 Mora et al.
5,487,419 A 1/1996 Weibel
5,531,821 A 7/1996 Wu
5,670,623 A 9/1997 Shoseyov et al.
5,731,080 A 3/1998 Cousin et al.
5,840,320 A 3/1998 Odom
5,817,381 A 11/1998 Chen et al.
5,837,376 A 11/1998 Knox et al.
5,964,983 A * 10/1999 Dinand et al. ..... 162/27
6,037,380 A 3/2000 Venables et al.
6,074,524 A * 6/2000 Wu et al. ..... 162/100
6,083,317 A 7/2000 Snowden et al.
6,083,582 A 7/2000 Chen et al.
6,117,305 A 9/2000 Bando et al.
6,117,474 A 9/2000 Kamada et al.
6,117,545 A 9/2000 Cavaille et al.
6,117,804 A 9/2000 Cho
6,132,558 A 10/2000 Dyllick-Brenzinger et al.
6,156,118 A 12/2000 Silenius
6,159,335 A * 12/2000 Owens et al. ..... 162/9
6,183,596 B1 2/2001 Matsuda et al.
6,202,946 B1 3/2001 Virtanen
6,207,436 B1 3/2001 Bjørnvad et al.
6,214,163 B1 4/2001 Matsuda et al.
6,235,150 B1 5/2001 Middleton et al.
6,312,669 B1 11/2001 Cantiani et al.
6,339,898 B1 1/2002 Toye
6,379,594 B1 4/2002 Dopfner et al.
6,436,232 B1 * 8/2002 Silenius et al. ..... 162/9
6,468,393 B1 * 10/2002 Small et al. ..... 162/134
6,579,410 B1 6/2003 Bleakley et al.
6,604,698 B2 8/2003 Verhoff et al.
6,647,662 B2 11/2003 Toye
6,669,882 B2 12/2003 Seok
6,726,807 B1 4/2004 Mathur
6,787,497 B2 9/2004 Dellve et al.
6,861,081 B2 3/2005 Weibel
7,022,756 B2 4/2006 Singer
7,048,900 B2 5/2006 Mathur et al.
7,083,703 B2 8/2006 Aho et al.
7,169,258 B2 1/2007 Rheims et al.
7,179,347 B2 2/2007 Rheims et al.
7,285,182 B2 10/2007 Mason et al.
7,381,294 B2 * 6/2008 Suzuki et al. ..... 162/9
7,459,493 B2 12/2008 Singer
7,462,232 B2 * 12/2008 Tuason et al. ..... 106/162.9
7,497,924 B2 3/2009 Nguyen et al.
7,594,619 B2 9/2009 Ghere, Jr. et al.
7,726,592 B2 6/2010 Fernandez et al.
7,790,276 B2 9/2010 Kanakarajan
7,799,358 B2 9/2010 Weibel
8,012,312 B2 9/2011 Goto et al.
8,012,573 B2 * 9/2011 Kowata et al. ..... 428/292.1
8,231,764 B2 * 7/2012 Husband et al. ..... 162/183
8,871,056 B2 * 10/2014 Gane et al. ..... 162/181.1
8,871,057 B2 * 10/2014 Gane et al. ..... 162/181.1
9,157,189 B2 10/2015 Heiskanen et al.
9,175,442 B2 * 11/2015 Gane ..... B41M 5/426
9,399,838 B2 7/2016 Leine et al.
2001/0011516 A1 8/2001 Cantiani et al.
2001/0045264 A1 11/2001 Rheims et al.
2002/0031592 A1 3/2002 Weibel
2002/0059886 A1 5/2002 Merkley et al.
2002/0198293 A1 12/2002 Craun et al.
2003/0051841 A1 3/2003 Mathur et al.
2003/0094252 A1 5/2003 Sundar et al.
2003/0114641 A1 6/2003 Kelly et al.
2004/0108081 A1 6/2004 Hughes
2004/0131854 A1 * 7/2004 Aho et al. ..... 428/403
2004/0146605 A1 7/2004 Weibel
2004/0149403 A1 8/2004 Rheims et al.
2004/0168782 A1 9/2004 Silenius et al.
2004/0168783 A1 9/2004 Munchow
2004/0173329 A1 9/2004 Silenius et al.
2004/0226671 A1 11/2004 Nguyen et al.
2005/0000665 A1 1/2005 Doelle
2005/0045288 A1 3/2005 Riou
2005/0051054 A1 3/2005 White et al.
2005/0089601 A1 4/2005 Weibel
2005/0103459 A1 5/2005 Mathur
2005/0116010 A1 6/2005 Gronroos et al.
2005/0133643 A1 6/2005 Fernandez et al.
2005/0194477 A1 9/2005 Suzuki
2005/0256262 A1 11/2005 Hill et al.
2006/0078647 A1 4/2006 Weibel
2006/0201646 A1 9/2006 Gussinyer Canadell
2006/0266485 A1 11/2006 Knox et al.
2006/0280839 A1 12/2006 Weibel
2006/0289132 A1 12/2006 Heijnesson-Hulten
2007/0062009 A1 3/2007 Ghere, Jr. et al.
2007/0131361 A1 6/2007 Doelle et al.
2007/0148365 A1 6/2007 Knox et al.
2007/0224419 A1 9/2007 Sumnicht et al.
2007/0226919 A1 10/2007 Mheidle
2007/0231568 A1 10/2007 Kanakarajan
2007/0272376 A1 11/2007 Maijala et al.
2008/0023161 A1 * 1/2008 Gather ..... 162/63
2008/0057307 A1 3/2008 Koslow et al.
2008/0060774 A1 * 3/2008 Zuraw et al. ..... 162/135
2008/0146701 A1 6/2008 Sain et al.
2008/0210391 A1 9/2008 Pfalzer et al.
2008/0265222 A1 10/2008 Ozersky et al.
2009/0020139 A1 1/2009 Sumnicht et al.
2009/0020248 A1 1/2009 Sumnicht et al.
2009/0065164 A1 3/2009 Goto et al.
2009/0084874 A1 4/2009 Alam et al.
2009/0221812 A1 9/2009 Ankerfors et al.
2010/0024998 A1 2/2010 Wildlock et al.
2010/0059191 A1 3/2010 Garcia Melgarejo et al.
2010/0132901 A1 6/2010 Wild
2010/0139527 A1 6/2010 Fernandez-Garcia
2010/0212850 A1 8/2010 Sumnicht et al.
2010/0233468 A1 9/2010 Loelovich et al.
2010/0272938 A1 * 10/2010 Mitchell et al. ..... 428/36.1
2010/0272980 A1 * 10/2010 Kowata et al. ..... 428/220
2011/0081554 A1 4/2011 Ankerfors et al.
2011/0088860 A1 4/2011 Heijnesson-Hulten et al.
2011/0114765 A1 5/2011 Brady et al.
2011/0186252 A1 * 8/2011 Subramanian et al. ..... 162/128
2011/0223401 A1 9/2011 Harlin et al.
2011/0259537 A1 * 10/2011 Husband et al. ..... 162/4

(56) References Cited

U.S. PATENT DOCUMENTS

| | | | | |
|---|---|---|---|---|
| 2011/0274908 | A1* | 11/2011 | Kowata et al. | 428/297.4 |
| 2011/0277947 | A1* | 11/2011 | Hua et al. | 162/28 |
| 2012/0043039 | A1* | 2/2012 | Paltakari et al. | 162/157.6 |
| 2012/0094953 | A1* | 4/2012 | Gane et al. | 514/57 |
| 2012/0107480 | A1* | 5/2012 | Gane et al. | 426/573 |
| 2012/0125547 | A1* | 5/2012 | Akai | 162/9 |
| 2012/0132383 | A1* | 5/2012 | Laine et al. | 162/175 |
| 2012/0205065 | A1 | 8/2012 | Esser | |
| 2012/0216718 | A1* | 8/2012 | Berglund et al. | 106/487 |
| 2012/0277351 | A1* | 11/2012 | Yano et al. | 524/35 |
| 2012/0318471 | A1* | 12/2012 | Turkki et al. | 162/181.3 |
| 2013/0000855 | A1 | 1/2013 | Nuopponen et al. | |
| 2013/0017349 | A1 | 1/2013 | Heiskanen et al. | |
| 2013/0053454 | A1* | 2/2013 | Heiskanen et al. | 514/781 |
| 2013/0126112 | A1* | 5/2013 | Gane et al. | 162/141 |
| 2013/0131193 | A1 | 5/2013 | Gane et al. | |
| 2013/0133848 | A1* | 5/2013 | Heijnesson-Hulten et al. | 162/141 |
| 2013/0180680 | A1* | 7/2013 | Axrup et al. | 162/177 |
| 2013/0284387 | A1* | 10/2013 | Umemoto et al. | 162/9 |
| 2013/0345416 | A1* | 12/2013 | Laukkanen et al. | 536/85 |
| 2014/0058077 | A1* | 2/2014 | Laukkanen et al. | 536/56 |
| 2014/0302337 | A1 | 10/2014 | Gane et al. | |
| 2014/0345816 | A1 | 11/2014 | Heiskanen et al. | |
| 2014/0370179 | A1* | 12/2014 | Gane | B82Y 30/00 426/573 |
| 2014/0371172 | A1 | 12/2014 | Gene et al. | |
| 2015/0101769 | A1* | 4/2015 | Laine et al. | 162/9 |
| 2015/0101770 | A1* | 4/2015 | Laine | D21H 11/18 162/9 |
| 2015/0144279 | A1* | 5/2015 | Laine | D21H 11/18 162/9 |
| 2015/0330024 | A1* | 11/2015 | Gane | D21H 11/18 162/149 |
| 2016/0273165 | A1* | 9/2016 | Laine | D21H 11/20 |
| 2016/0299119 | A1 | 10/2016 | Laukkanen et al. | |

FOREIGN PATENT DOCUMENTS

| | | | |
|---|---|---|---|
| CA | 1149219 | A1 | 7/1983 |
| CA | 1162819 | | 2/1984 |
| CA | 2093545 | | 10/1993 |
| CA | 2292587 | A1 | 12/1998 |
| CA | 2093545 | C | 3/2001 |
| CA | 2437616 | A1 | 8/2003 |
| CA | 2750082 | A1 | 8/2010 |
| CH | 648071 | A5 | 2/1985 |
| CN | 1089675 | A | 7/1994 |
| CN | 1173904 | A | 2/1998 |
| CN | 1200128 | A | 11/1998 |
| CN | 1278830 | A | 1/2001 |
| CN | 2437616 | Y | 7/2001 |
| CN | 1524145 | A | 8/2004 |
| CN | 1585839 | A | 2/2005 |
| CN | 1585839 | A1 | 2/2005 |
| CN | 101360863 | A | 2/2005 |
| CN | 1665984 | A | 9/2005 |
| CN | 101203644 | A | 6/2008 |
| CN | 101360863 | A | 2/2009 |
| DK | 175143 | B1 | 6/2004 |
| EP | 51230 | A1 | 5/1982 |
| EP | 39628 | B1 | 7/1984 |
| EP | 0198622 | A1 | 10/1986 |
| EP | 273745 | A2 | 7/1988 |
| EP | 273745 | B1 | 7/1988 |
| EP | 442183 | A1 | 8/1991 |
| EP | 492600 | A1 | 7/1992 |
| EP | 499578 | A1 | 8/1992 |
| EP | 0614948 | A1 | 9/1994 |
| EP | 619140 | A2 | 10/1994 |
| EP | 0726356 | A1 | 8/1996 |
| EP | 579171 | B1 | 1/1997 |
| EP | 785307 | A2 | 7/1997 |
| EP | 790135 | A2 | 8/1997 |
| EP | 619140 | B1 | 5/1999 |
| EP | 0935020 | A1 | 8/1999 |
| EP | 0949294 | A1 | 10/1999 |
| EP | 988322 | A1 | 3/2000 |
| EP | 1053213 | A1 | 11/2000 |
| EP | 988322 | B1 | 1/2002 |
| EP | 1053213 | B1 | 5/2002 |
| EP | 785307 | B1 | 9/2002 |
| EP | 0852588 | B1 | 1/2003 |
| EP | 1469126 | A1 | 10/2004 |
| EP | 1538257 | A1 | 6/2005 |
| EP | 1936032 | A1 | 6/2008 |
| EP | 2196579 | A1 | 6/2010 |
| EP | 2216345 | A1 | 8/2010 |
| EP | 2236545 | A1 * | 10/2010 |
| EP | 2236664 | A1 * | 10/2010 |
| EP | 1907626 | B1 | 11/2010 |
| EP | 2386682 | B1 | 11/2011 |
| EP | 2386683 | B1 | 3/2014 |
| EP | 2640893 | B1 | 8/2017 |
| ES | 2100781 | A1 | 6/1997 |
| FR | 2689530 | A1 | 10/1993 |
| FR | 2774702 | | 8/1999 |
| GB | 663621 | | 12/1951 |
| GB | 2260146 | A | 4/1993 |
| GB | 2265916 | A | 10/1993 |
| GB | 2275876 | A | 9/1994 |
| GB | 2528487 | A | 1/2016 |
| JP | 1156587 | A | 6/1989 |
| JP | 2528487 | B | 6/1989 |
| JP | H04-81813 | A | 3/1992 |
| JP | 05098589 | | 4/1993 |
| JP | 6158585 | A | 6/1994 |
| JP | 199406240588 | A | 8/1994 |
| JP | 08081896 | A | 3/1996 |
| JP | 199681896 | | 3/1996 |
| JP | 1996081896 | A | 3/1996 |
| JP | 199608081896 | A | 3/1996 |
| JP | 2528487 | B2 | 8/1996 |
| JP | 8284090 | A | 10/1996 |
| JP | 199608284090 | A | 10/1996 |
| JP | 9-124702 | A | 5/1997 |
| JP | 10158303 | A | 6/1998 |
| JP | 199681896 | | 6/1998 |
| JP | 10237220 | A | 9/1998 |
| JP | 11-269796 | A | 10/1999 |
| JP | 276485 | B2 | 11/1999 |
| JP | 2976485 | B2 | 11/1999 |
| JP | 2981555 | B1 | 11/1999 |
| JP | 2000-170029 | A | 6/2000 |
| JP | 3421446 | B2 | 6/2003 |
| JP | 2004231796 | | 8/2004 |
| JP | 2004523676 | A | 8/2004 |
| JP | 2004-534911 | A | 11/2004 |
| JP | 2005505708 | A | 2/2005 |
| JP | 2006008857 | A | 1/2006 |
| JP | 2007262594 | A | 10/2007 |
| JP | 2008007899 | A | 1/2008 |
| JP | 2008150719 | A | 7/2008 |
| JP | 2008169497 | A | 7/2008 |
| JP | 2009161613 | A | 7/2009 |
| JP | 2009243014 | A | 10/2009 |
| JP | 2009263854 | | 11/2009 |
| JP | 2010168716 | A | 8/2010 |
| JP | 2010202987 | | 9/2010 |
| JP | 2010202987 | A | 9/2010 |
| JP | 2012-522145 | A | 9/2012 |
| JP | 5666553 | B2 | 2/2015 |
| JP | 5894525 | B2 | 3/2016 |
| KR | 20080096747 | A | 11/2008 |
| NL | 8102857 | | 1/1983 |
| RU | 2208079 | C2 | 7/2003 |
| SU | 499366 | A1 | 1/1977 |
| TW | 200609278 | | 3/2006 |
| TW | 201013017 | A1 | 4/2010 |
| WO | 1993001333 | A1 | 1/1993 |
| WO | 199315270 | | 8/1993 |
| WO | 94/05595 | A1 | 3/1994 |
| WO | 199404745 | | 3/1994 |

(56) References Cited

FOREIGN PATENT DOCUMENTS

| | | | |
|---|---|---|---|
| WO | 9712917 | A1 | 4/1997 |
| WO | 199712917 | A1 | 4/1997 |
| WO | 199718897 | | 5/1997 |
| WO | 98/28362 | A1 | 7/1998 |
| WO | 9856860 | A1 | 12/1998 |
| WO | 199855693 | | 12/1998 |
| WO | 199856826 | | 12/1998 |
| WO | 1998956860 | A2 | 12/1998 |
| WO | 199954045 | | 10/1999 |
| WO | 200166600 | A1 | 9/2001 |
| WO | 200198231 | A1 | 12/2001 |
| WO | 2002086238 | A1 | 10/2002 |
| WO | 02090651 | A1 | 11/2002 |
| WO | 2002090651 | A1 | 11/2002 |
| WO | 02100955 | A1 | 12/2002 |
| WO | 2002100955 | A1 | 12/2002 |
| WO | 03033815 | A2 | 4/2003 |
| WO | 2003033815 | A2 | 4/2003 |
| WO | 2004016852 | A2 | 2/2004 |
| WO | 2004055267 | A1 | 7/2004 |
| WO | 2005014934 | A2 | 2/2005 |
| WO | 2005100489 | A1 | 10/2005 |
| WO | 2005/123840 | A1 | 12/2005 |
| WO | 2005123840 | A1 | 12/2005 |
| WO | 2006009502 | A1 | 1/2006 |
| WO | 2006/041401 | A1 | 4/2006 |
| WO | 2006/136651 | A1 | 12/2006 |
| WO | 2007/006794 | A1 | 1/2007 |
| WO | 2007088974 | A1 | 8/2007 |
| WO | 2007091942 | A1 | 8/2007 |
| WO | 2007096180 | A2 | 8/2007 |
| WO | 20071088974 | A1 | 8/2007 |
| WO | 2007110639 | A1 | 10/2007 |
| WO | 2008/008576 | A2 | 1/2008 |
| WO | 2008033283 | A1 | 3/2008 |
| WO | 2008076056 | A1 | 6/2008 |
| WO | 2008076071 | A1 | 6/2008 |
| WO | 2008095764 | A1 | 8/2008 |
| WO | 2008132228 | A1 | 11/2008 |
| WO | 2009074491 | A1 | 6/2009 |
| WO | 2009/123560 | A1 | 10/2009 |
| WO | 2009122982 | A1 | 10/2009 |
| WO | 2009126106 | A1 | 10/2009 |
| WO | 2009/153225 | A1 | 12/2009 |
| WO | 2010/003860 | A2 | 1/2010 |
| WO | 2010015726 | A1 | 2/2010 |
| WO | WO 2010015726 | A1 * | 2/2010 |
| WO | WO 2010092239 | A1 * | 8/2010 |
| WO | 2010102802 | A1 | 9/2010 |
| WO | 2010112519 | A1 | 10/2010 |
| WO | WO 2010115785 | A1 * | 10/2010 |
| WO | 2010125247 | A2 | 11/2010 |
| WO | WO 2010131016 | A2 * | 11/2010 |
| WO | 2011004300 | A1 | 1/2011 |
| WO | 2011004301 | A1 | 1/2011 |
| WO | 2011/042607 | A1 | 4/2011 |
| WO | 2011/048000 | A1 | 4/2011 |
| WO | 2011/056130 | A1 | 5/2011 |
| WO | 2011/059398 | A1 | 5/2011 |
| WO | 2011/068457 | A1 | 6/2011 |
| WO | 2011064441 | A1 | 6/2011 |
| WO | 2011/141876 | A1 | 11/2011 |
| WO | 2011/141877 | A1 | 11/2011 |
| WO | WO 2011134938 | A1 * | 11/2011 |
| WO | WO 2011134939 | A1 * | 11/2011 |
| WO | 2011/154335 | A1 | 12/2011 |
| WO | 2012/039668 | A1 | 3/2012 |
| WO | 2012098296 | A2 | 7/2012 |
| WO | 2014091212 | A1 | 6/2014 |

OTHER PUBLICATIONS

Machine Translation of JPH 0881896 A Published on Mar. 26, 1996.*

International Search Report, dated May 27, 2011 for PCT Application No. PCT/EP2011/056542.

Written Opinion of the International Searching Authority dated May 27, 2011 for related PCT Application No. PCT/EP2011/056542.

3rd Party Observations dated Jun. 11, 2012 for related European Patent Application No. 10161166.3.

Communication from the European Patent Office dated Aug. 6, 2013 for European Patent Application No. 11716257.8.

Response to the Communication dated Nov. 5, 2013 for European Patent Application No. 11716257.8.

Third Party Observations dated Oct. 21, 2011 for European Application No. EP 09156703.2.

European Search Report dated Jun. 26, 2009 for European Application No. EP 09156703.2.

Third Party Observations dated Jun. 6, 2012 for European Application No. EP 091566683.6.

Third Party Observations dated Oct. 21, 2011 for European Application No. EP 091566683.6.

Third Party Observations dated Jun. 11, 2012 for European Application No. EP 10711423.3.

Third Party Observations dated Feb. 17, 2012 for European Application No. EP 10711423.3.

Third Party Observations dated Jun. 6, 2012 for European Application No. EP 09156703.2.

Third Party Observations dated May 18, 2011 for European Application No. EP 09156703.2.

Third Party Observations dated Jun. 11, 2012 for European Application No. EP 10713884.4.

Third Party Observations dated Feb. 17, 2012 for European Application No. EP 10713884.4.

Third Party Observations dated Feb. 4, 2013 for European Application No. EP 11719499.3.

Third Party Observations dated Apr. 12, 2013 for European Application No. EP 10161166.3.

Third Party Observations dated Jan. 9, 2012 for European Application No. EP 10161166.3.

Third Party Observations dated Feb. 4, 2013 for European Application No. EP 11716257.8.

Notice of Opposition dated Dec. 19, 2014 for European Patent No. EP2386682.

Subramanian et al. "Calcium carbonate—cellulose fibre composites; the role of pulp refining." Paper Technology Dec. 2006 Pulp Refining, pp. 27 to 31.

Third Party Observation dated Jan. 9, 2012 for European Application No. 10161173.9.

Third Party Observation dated Jun. 11, 2012 for European Application No. 10161173.9.

Third Party Observation dated Apr. 19, 2013 for European Application No. 10161173.9.

Office Action dated Sep. 24, 2012 for European Application No. 10711 423.3-2115.

Office Action dated Jan. 16, 2013 for Chinese Application No. 201080015262.5.

Third Party Observations dated May 27, 2011 for European Application No. 09156683.6.

Search Report dated Jun. 6, 2009 for European Application No. 09156683.6.

International Search Report dated Jun. 7, 2010 for PCT Application No. PCT/EP2010/054231.

International Search Report dated Aug. 17, 2010 for PCT Application No. PCT/EP2010/054233.

International Search Report dated Jun. 22, 2011 for PCT Application No. PCT/EP2011/056540.

Office Action dated Jan. 27, 2014 for U.S. Appl. No. 13/138,646.

Office Action dated Jan. 28, 2014 for U.S. Appl. No. 13/138,647.

Falini et al. "Oriented crystallization of vaterite in collagenous matrices." Chem. Eur. J. 1998, 4, 1048-1052.

Campinhos Jr. "Sustainable plantations of high-yield Eucalyptus trees for production of fiber: the Aracruz case." New Forests, 1999, 17, 129-143.

Auad et al. "Characterization of nanocellulose-reinforced shape memory polyurethanes." Polymer International, 2008, 57, 651-659. Online Publication Date: Dec. 13, 2007.

(56) References Cited

OTHER PUBLICATIONS

Dupont "Cellulose in lithium chloride/N, N-dimethylacetamide, optimisation of a dissolution method using paper substrates and stability of the solutions." Polymer 2003, 44, 4117-4126.
Patt et al. "Paper and pulp." Ullmann's Encyclopedia of Industrial Chemistry, published online Jun. 2000.
Siró et al. "Microbibrillated cellulose and new nanocomposite materials: a review." Cellulose 2010, 17, 459-494.
Written Opinion of the International Searching Authority dated Jun. 7, 2010 for PCT Application No. PCT/EP2010/054231.
Written Opinion of the International Searching Authority dated Aug. 17, 2010 for PCT Application No. PCT/EP2010/054233.
Written Opinion of the International Searching Authority dated Jun. 22, 2011 for PCT Application No. PCT/EP2010/056540.
Sixta "Handbook of Pulp." Wood Structure and Morphology, vol. 1 (2006).
Hubbe et al. "What happens to cellulosic fibers during papermaking and recycling? A Review." Bioresources (2007), 2:4, 739-788.
Hubbe "Mini-encyclopedia of papermaking wet-end chemistry." NC State University Internet Citation, Aug. 17, 2010, p. 1.
Little et al. "Hydrated lime—more than just a filler." National Lime Association (May 2001), 1-16.
Office Action dated Nov. 18, 2015 for U.S. Appl. No. 13/640,513.
Herrick et al. " Microfibrillated Cellulose: Morphology and Accessibility." Journal of Applied Polymer Science, Applied Polymer Symposium 37,—Proceedings of the Ninth Cellulose Conference. II. Symposium on Cellulose and Wood as Future Chemical Feedstocks and Sources of Energy, and General Papers, John Wiley & Sons, Inc.
Kumar et al. "Comparison of nano- and microfibrillated cellulose films." Cellulose (2014) 21:3443-3456.
Paakko et al., "Enzymatic Hydrolysis Combined with Mechanical Shearing and High-Pressure Homogenization for Nanoscale Cellulose Fibrils and Strong Gels." Biomacromolecules (2007) 8, 1934-1941.
Australia, Examination Report No. 1 dated Sep. 16, 2015 from corresponding Australian Patent Application No. 2014227494.
Canada, Examination Report dated Apr. 26, 2016 from corresponding Canadian Patent Application No. 2,796,135.
Canada, Examination Report dated Sep. 3, 2015 from corresponding Canadian Patent Application No. 2,796,135.
China, Office Action dated Apr. 10, 2015 from corresponding Chinese Patent Application No. 201180020953.9.
China, Office Action dated Jan. 13, 2015 from corresponding Chinese Patent Application No. 201180020953.9.
China, Office Action dated May 22, 2014 from corresponding Chinese Patent Application No. 201180020953.9.
China, Office Action dated Jan. 16, 2013 for Chinese Application No. 201080015262.5.
Columbia, Office Action dated Sep. 3, 2013 from corresponding Columbian Patent Application No. 12-182.195 filed on Apr. 26, 2011.
Europe, Examination Report from the European Patent Office dated Oct. 11, 2013 from corresponding European Patent Application No. 11 719 499.3.
Europe, Examination Report from the European Patent Office dated Mar. 15, 2013 from corresponding European Patent Application No. 10 161 166.3.Europe, Examination Report from the European Patent Office dated Mar. 15, 2013 from corresponding European Patent Application No. 10 161 166.3.
Europe, Third Party Observations dated Oct. 21, 2011 for European Application No. 09156703.2.
Europe, Third Party Observations dated Feb. 17, 2012 for European Application No. EP 10711423.3.
Indonesian Office Action dated Apr. 18, 2017 from corresponding Indonesian Patent Application No. WO 00 2012 04369.
International Search Report from parent PCT/EP2011/056542, filed on Apr. 26, 2011 with a priority date of Apr. 27, 2010.
Japan, Office Action dated Dec. 1, 2015 from corresponding Japanese Patent Application No. 2013-506621.
Japan, Office Action dated Mar. 31, 2015 from corresponding Japanese Patent Application No. 2013-506621.
Korea, Office Action dated Jul. 29, 2016 from corresponding Korean Patent Application No. 10-2012-7030761.
Patt, R., et al., "Paper and Pulp," Ullmann's Encyclopedia of Industrial Chemistry. Published online: Jun. 2000.
PCT, International Preliminary Report on Patentability and Written Opinion dated Oct. 4, 2011 from corresponding PCT Patent Application No. PCT/EP2010/054231.
Russia, Office Action from corresponding Russian Patent Application No. 2011143854 filed on Mar. 10, 2010.
Russia, Official Action dated Apr. 22, 2015 from corresponding Russian Patent Application No. 2015109771.
Russia, Official Action of Jan. 21, 2014 from corresponding Russian Patent Application No. 2011143854, (Abstract) from corresponding EP No. 36545.
Skomgboon, et al. Grit segments in TMP refining. Part 2: Potential for energy reduction, Appita Journal, vol. 62, No. 1, 2009, pp. 42-45 and 59.
Smook, Handbook for Pulp and Paper Technologies, 1992, Angus Wilde Publications, 2nd Edition, Chap. 13.
Somboon, et al. "Grit segments in TMP refining. Part 1: Operating parameters and pulp quality", Appita Journal, vol. 62, No. 1, 2009, pp. 37-41.
Somboon, et al. "Grit segments in TMP refining. Part 2: Potential for energy reduction", Appita Journal, vol. 62, No. 1, 2009, pp. 42-45 and 59.
Somboon, Phichit, "On the Application of Grits to Thermomechanical Pulp Refining." TKK Reports on Forest Products Technology, Series A7, Espoo 2009, 61 pages.
Spence, et al. "The effect of chemical composition on microfibrillar cellulose films from wood pulps: Mechanical processing and physical properties", BioResource Technology, vol. 101, 2010, pp. 5961-5968.
Subramanian et al. "Calcium carbonate—cellulose fibre composites; the role of pulp refining." Paper Technology, Dec. 2006, pp. 1 to 5.
Subramanian et al. "Engineering fine paper by utilising the structural elements of the raw materials." Helsinki University of Technology, Department of Forest Products Technology, Seris A 1, Espoo 2008, pp. 1 to 66.
Syverud, et al. "The influence of microfibrillated cellulose, MFC, on paper strength and surface properties", pp. 1-32.
Taiwan, Examination and Search Report dated May 17, 2016 from corresponding Taiwan Patent Application No. 100114616.
Taiwan Office Action for related Taiwanese Application No. 099115704, dated Jul. 14, 2014.
Taniguchi, Takashi, "New Films Produced from Microfibrillated Natural Fibres", Polymer International, vol. 47, 1998, pp. 291-294.
Terao, et al. "Pulp-Filler Interaction (3)—The Influence of Wet Pressing and Cellulosic Fines Addition on the Structure and Properties of Filler Loaded Papers", vol. 8, 1989, pp. 65-73.
Torvinen, et al. "Flexible filler—nanocellulose structures", VTT Technical Research Centre of Finland—1 page.
UK Search Report for UK Application No. GB0908401.3, dated Sep. 14, 2009.
Vietnam, Third Examination Report dated Apr. 28, 2016 from corresponding Vietnamese Patent Application No. 1-2012-03429 filed on Apr. 26, 2011.
Vietnam, Second Examination Report dated Oct. 8, 2015 from corresponding Vietnamese Patent Application No. 1-2012-03429 filed on Apr. 26, 2011.
Vietnam, First Examination Report dated Dec. 30, 2014 from corresponding Vietnamese Patent Application No. 1-2012-03429 filed on Apr. 26, 2011.
Waterhouse, J.F., "Whither Refining?", Institute of Paper Science and Technology, No. 649, 1997, 41 pages.
Zhao, et al. "Ultrasonic technique for extracting nanofibers from nature materials" Applied Physics Letters 90, 073112, 2007, 2 pages.
Zirconium Oxide Data sheet,, downloaded online from www.stanfordmaterials.com, downloaded on Jan. 12, 2012.

(56) References Cited

OTHER PUBLICATIONS

Zirconium Silicate Data sheet, downloaded online from www.reade.com, downloaded on Jan. 12, 2012.
Zou, et al. "Review of Microfibrillated Cellulose (MFC) for Papermaking", Pulp and Paper Engineering, School of Chemical and Biomolecular Eng., Georgia Institute of Technology, 10 pages.
Zou, Xuejun, "Production of Nanocrystalline Cellulose and its Potential Applications in Specialty Papers", Pira Specialty Papers Conference, Nov. 2010, pp. 1-30.
Abe, et al. "Obtaining Cellulose Nanofibers with a Uniform Width of 15 nm from Wood", Biomacromolecules, vol. 8, Width of 15 nm from Wood, Biomacromolecules, vol. 8, 2007, pp. 3276-3278.
Ahola, Susanna, "Properties and Interfacial Behaviour of Cellulose Nanofibrils." Doctoral Thesis, 2008, 82 pages.
Ankerfors, et al. "NanoCellulose Developments in Scandinavia", Paper and Coating Chemistry Symposium (PCCS), Jun. 2009, Hamilton, Canada, 43 pages.
Ankerfors, Mikael, "The manufacture of microfibrillated cellolose (MFC) its applications." Nanostructured cellulose and new cellulose derivatives seminar, Nov. 2006, pp. 1-40.
Atrex G-Series, Megatrex, "Technology for Reject Treatment and Recovery", 2 pages.
Australia, Patent Examination Report dated Jul. 26, 2012 for related Australian Patent Application No. 2010247184.
Australia, Patent Examination Report No. 1 dated Feb. 26, 2014 for related Australian Patent Application No. 2013202515.
Berglund, et al. "Nanostructured Cellulose Products", Finnish-Swedish Wood Material Science Research Programme Opening Seminar, 2004, Helsinki, Finland, 28 pages.
Bhatnagar, et al. "Processing of Cellulose Nanofiber-reinforced Composites", Journal of Reinforced Plastics and Composites, vol. 24, No. 12, 2005, pp. 1259-1268.
Canada, Office Action dated Dec. 18, 2013 for related Canadian Application No. 2,748,137.
China, Office Action dated Jan. 6, 2014 for related Chinese Application No. 201080003690.6.
Chinga-Carrasco, et al. "Computer-assisted quantification of the Iti-scale structure of films made of nanofibrillated cellulose", J. Nanopart Res., 2010, pp. 841-851.
Eichhorn et al., "Review: current international research into cellulose nanofibres and nanocomposites." Journal of Materials Science, vol. 45, No. 1, 2010, pp. 841-851.
Eriksen et al. "The use of microfibrillated cellulose produced from kraft pulp as strength enhancer in TMP paper", Nordic Pulp and Paper Research Journal, vol. W . . . No. 3, 2008, pp. 299-304.
Europe, Third Party Observations pursuant to Article 115(1)EPC concerning European Patent Application No. 10 727 476.3, dated Jul. 22, 2014, 18 pgs.
Europe, Extended European Search Report dated Jan. 15, 2013, for related EP Application No. 12189681.5.
Europe, Office Action dated Feb. 6, 2014 for related EP Application No. 12 189 681.5-1308.
Europe, Office Action dated Mar. 7, 2014, in related EP Application No. 10 727 476.3-1308.
Europe, Office Action dated May 26, 2014, in related EP Application No. 10 727 476.3-1308.
Europe, Office Action dated Nov. 30, 2012 for related EP Application No. 10 727 476.3-2124.
Europe, Office Action dated Oct. 25, 2013 for related EP Application No. 10 727 476.3-1308.
Europe, Third Party Observations pursuant to Article 115(1)EPC concerning European Patent Application No. 12 189 681.5, dated Jul. 10, 2014, 15 pgs.
Fukui, Yoshitaka, "Microfibrillated Cellulose", vol. 60, No. 24, 1985, pp. 5-12.
GL&V, The Atrex System at M-real Hallein Paper Mill in Austria, "Atrex is running well and us money!" 4 pages.
Henriksson, "Cellulose Nanofibril Networks and Composites" Preparation, Structure and Properties, KTH Chemical Science and Engineering, 2008, 61 pages.
Henriksson, et al. "Cellulose Nanopaper Structures of High Toughness", Biomacromolecules, vol. 9, 2008, pp. 1579-1585.
Hentze, Hans-Peter, "From Nanocellulose Science towards Applications", VTT—Technical Research Center of Finland, PulPaper 2010, Jun. 2010, Helsinki, pp. 1-24.
http://puu.tkk.fl/en/research/research_groups/chemical_pulping_and_wood_refinery/seminar_presentations/knuts_100609_laitoksen_sisainen_seminaariesitys.pdf;Knuts, M. SC. Aaro, "Process installation and optimization to refine and produce NFC materials." pp. 1-.
Inventia—Processes for Nanocellulose, http://www.innventia.com/templates/STFIPage_9108.aspx, 1 page.
Iwamoto, et al. "Nano-fibrillation of pulp fibers for the processing of transparent nanocomposites", Applied Physics A, vol. 89, 2007, pp. 461-466.
Iwamoto, et al. "Optically transparent composites reinforced with plant fiber-based nanofibers", Applied Physics A, vol. 81, 2005, pp. 1109-1112.
Janardhnan, et al. "Isolation of Cellulose Microfibrils—An Enzymatic Approach", BioResources, vol. 1, No. 2, 2006, pp. 176-188.
Kang, Taegeun, "Role of External Fibrillation in Pulp and Paper Properties", Doctoral Thesis, Helsinki University of Technology, Laboratory of Paper and Printing Technology Reports, Series A28, Espoo 2007, 51 pages.
Klemm, et al. "Nanocelluloses as Innovative Polymers in Research and Application", Adv. Polymer Science, vol. 205, 2006, pp. 49-96.
Klungness, et al. "Fiber-Loading: A Progress Report", TAPPI Proceedings, 1994 Recycling Symposium, pp. 283-290.
Littunen, Kuisma, "Free radical graft copolymerization of microfibrillated cellulose", Master's Thesis, Helsinki University of Technology, Sep. 2009, 83 pages.
Loelovich, et al. "Structure and Properties of Nanoparticules Used in Paper Compositions", Mechanics of Composite Materials, vol. 46, No. 4, 2010, pp. 435-442.
Loelovich, Michael, "Cellulose as a Nanostructured Polymer: A Short Review." BioResources, vol. 3, No. 4, 2008, pp. 1403-1418.
Luukkanen, Lauri, "Reducing of Paper Porosity and Roughness Through Layered Structure", Aalto University School of Science and Technology, Master's thesis for the degree of Master of Science in Technology, Espoo, May 2010, 132 pages.
Mathur, V. "GRI's Fibrous Filler Technology Presentation to TAPPI", Philadelphia, PA (slides only), 2005, pp. 1-10.
Mill (grinding) http://en_wikipedia.org/w/index.php?title-File:Hammer_mill_open_front_full.jgp, 8 pgs.
Mori, et al. "Effect of cellulose nano-fiber on calcium carbonate crystal form", Polymer Preprints, Japan, vol. 56, No. 2, 2007—1 page.
Morseburg, et al. "Assessing the combined benefits of clay and nanofibrillated cellulose in layered TMP-based sheets", Cellulose, No. 5, vol. 16, 2009, pp. 795-806.
Mullite, 2001 [downloaded online Dec. 6, 2016], Minerals Data Publishing.
Nakagaito, et al. "The effect of fiber content on the mechanical and thermal expansion properties of biocomposites based on microfibrillated cellulose", Cellulose, vol. 15, 2008, pp. 459-494.
Peltola, Maarit, "Preparation of Microfibrillated Cellulose" Master of Science Thesis, Tampere University of Technology, May 2009, 98 pages.
China, First Notification of Office Action from corresponding Chinese Patent Application No. 201510628033.5 dated Jan. 10, 2017.
India, Examination Report dated Jun. 12, 2017 from corresponding Indian Patent Application No. 1474/MUMNP/2011.
Korea, Notice of Rejection from corresponding Korean Patent Application No. 10-2015-7030983 dated Jul. 29, 2016.
Pinkney et al., "Microfibrillated Cellulose—A New Structural Material." Engineering Doctorate Conference (2012), University of Birmingham, (2 pgs.).
Porubska, et al. "Homo- and heteroflocculation of papermaking fines and fillers", Colloids and Surfaces A: Physiochem. Eng. Aspects, Elsevier Science, vol. 210, 2002, pp. 223-230.

(56) References Cited

OTHER PUBLICATIONS

Saito, et al. "Homogeneous Suspensions of Individualized Microfibrils from TEMPO-Catalyzed Oxidation of Native Cellulose", Biomacromolecules, American Chemical Society, vol. 7, No. 6, 2006, pp. 1687-1691.
Silenius, Petri, "Improving the Combinations of Critical Properties and Process Parameters of Printing and Writing Papers and Paperboards by New Paper-Filling Methods", Helsinki University of Technology Laboratory of Paper Technology Reports, Series A 14, Espoo 2002, 168 pages.
Canada, Office Action dated Jan. 7, 2014 for Canadian Application No. 2,755,495.
Europe, Communication from the European Patent Office dated Aug. 6, 2013 for European Application No. 11716257.8.
Europe, European Search Report dated Sep. 7, 2010 for European Application No. 10161173.9.
Europe, Office Action dated Feb. 15, 2013 for European Application No. 11716257.
Europe, Office Action dated Feb. 21, 2013 for European Application No. 10713884.4.
Europe, Office Action dated Feb. 7, 2013 for European Application No. 09156683.6.
Europe, Office Action dated Feb. 7, 2013 for European Application No. 09156703.2.
Europe, Office Action dated Jan. 2, 2014 for European Application No. 09156683.6.
Europe, Office Action dated Jan. 2, 2014 for European Application No. 10713884.4.
Europe, Office Action dated Jul. 31, 2013 for European Application No. 09156683.6.
Europe, Office Action dated Jul. 31, 2013 for European Application No. 09156703.2.
Europe, Office Action dated Jun. 27, 2011 for European Application No. 09156683.6.
Europe, Office Action dated Mar. 15, 2013 for European Application No. 10161166.3.
Europe, Office Action dated Mar. 15, 2013 for European Application No. 10161173.9.
Europe, Office Action dated Mar. 26, 2014 for European Application No. 10711423.3.
Europe, Office Action dated May 20, 2011 for European Application No. 09156703.2.
Europe, Office Action dated Oct. 11, 2013 for European Application No. 11719499.
Europe, Office Action dated Sep. 24, 2012 for European Application No. 10711423.3.
Europe, Party Observations dated Jun. 11, 2012 for European Application No. EP 10713884.4.
Europe, Response to the Communication dated Nov. 5, 2013 or European Application No. 11716257.8.
Europe, Search Report dated Jun. 26, 2009 for European Application No. 09156683.6.
Europe, Search Report dated Sep. 8, 2010 for European Application No. 10161166.3.
Europe, Third Party Observation dated Jun. 6, 2012 for European Application No. 09156703.2.
Europe, Third Party Observation dated May 18, 2011 for European Application No. 09156703.2.
Europe, Third Party Observation dated Oct. 21, 2011 for European Application No. 09156683.6.
Europe, Third Party Observations dated Feb. 4, 2013 for European Application No. EP 11719499.
Europe, Third Party Observations dated Jun. 11, 2012 for European Application No. 10161166.3.
Europe, Third Party Observations dated Jun. 11, 2012 for European Application No. 10161173.9.
Europe, Third Party Observations dated Jun. 26, 2009 for European Application No. EP 09156703.2.
Postek et al., "Production and Applications of Cellulose Nanomaterials," TAPPI Press (2013) Chapter 2, pp. 169-173.
Sofia et al., "A Comparision of Cellulose Nanocrystals and Cellulose Nanofibres Extracted from Bagasse Using Acid and Ball Milling Methods," Adv. Nat Sci.: Nanosci. Nanotechnol., (2016) 7, 9 pages.
Taiwan Examination Report dated Feb. 11, 2014 for Taiwanese Application No. 099109562.
Turbak, A. F., "Birth of nanocellulose," http://www.naylornetwork.com/PPI-OTW/articles/print.asp?aid=150993, undated, downloaded Nov. 1, 2015.
Europe Office Action dated Mar. 10, 2017 from corresponding European Patent Application No. 10 713 884.4.
Europe, Office Action dated May 2, 2016 from corresponding European Patent Application No. 10 713 884.4.
Europe, Office Action of Oct. 27, 2015 from corresponding European Patent Application No. 14 175 471.3.
Europe, Office Action dated Sep. 16, 2016 from corresponding European Patent Application No. 14 175 471.3.
Europe, Third Party Observations dated Apr. 12, 2013 for European Application No. EP 10161173.9.
Europe, Third Party Observations dated Jan. 9, 2012 for European Application No. EP 10161173.9.
De Oliveira et al., "Synthesis and Characterization of Microcrystaliine Cellulose Produced from Bacterial Cellulose," J. Therm. Anal. Caiorim, (2011) 106, pp. 703-709.
Russia, Office Action dated Mar. 30, 2010 for Russian Application No. 2011143811.
Taiwan, Examination Report dated Feb. 11, 2014 for Taiwanese Application No. 099109562.
Ukraine, Office Action for Ukrainian Application No. a 2011 12682.
Europe, Third Party Observations dated Feb. 4, 2013 for European Application No. EP 11716257.8.
Indonesia, Information Notification dated Mar. 10, 2016 for corresponding Indonesian Patent Application No. W-00 2011 03469.
Australian Examination Report dated May 3, 2013 from corresponding Australian Patent Application No. 2011246522.
Australian Examination Report No. 1 dated Sep. 16, 2015 from corresponding Australian Patent Application No. 2014227494.
Canadian Examination Report dated Apr. 26, 2016 from corresponding Canadian Patent Application No. 2,796,135.
Canadian Examination Report dated Sep. 3, 2015 from corresponding Canadian Patent Application No. 2,796,135.
Chinese Office Action dated Jan. 13, 2015 from corresponding Chinese Patent Application No. 201180020953.9.
Chinese Office Action dated May 22, 2014 from corresponding Chinese Patent Application No. 201180020953.9.
European Examination Report from the European Patent Office dated Mar. 29, 2016 from corresponding European Patent Application No. 11 719 499.3.
European Examination Report from the European Patent Office dated Oct. 11, 2013 from corresponding European Patent Application No. 11 719 499.3.
European Examination Report from the European Patent Office dated Mar. 15, 2013 from corresponding European Patent Application No. 10 161 166.3.
International Preliminary Report on Patentability dated Oct. 30, 2012 from corresponding PCT/EP2011/056542 filed on Apr. 26, 2011.
Japanese Office Action dated Dec. 1, 2015 from corresponding Japanese Patent Application No. 2013-506621.
Japanese Office Action dated Mar. 31, 2015 from corresponding Japanese Patent Application No. 2013-506621.
Korean Office Action dated Jul. 29, 2016 from corresponding Korean Patent Application No. 10-2012-7030761.
Taiwan Examination and Search Report dated May 17, 2016 from corresponding Taiwan Patent Application No. 100114616.
Europe, Search Report dated Jun. 26, 2009 for European Application No. EP 09156703.2.
Russia, Office Action for Russian Application No. 2011143854.
Characterisation Newsletter, "Microfibrillated Cellulose", No. 5, Jan. 2009, pp. 1-2.
Europe, Partial European Search Report of EP Application No. 16163032.

(56) References Cited

OTHER PUBLICATIONS

Optifiner™ DF Deflakers, "Improved quality through effective deflaking." Stock Preparation and Recycled Fiber Systems, Metso Paper, 4 pages.
Sinnott, et al. "Slurry Flow in a Tower Mill", Seventh International Conference on CFO in the Minerals and Process Industries, CSIRO, Melbourne, Australia, Dec. 9-11, 2009, pp. 1-7.
Yano, Hiroyuki, "High Performance of Bio Fibers by the Addition of Filler", vol. 55, Machine No. 4, 2009, pp. 63-68.
Chile, Examination Report dated Dec. 13, 2013 from corresponding Chilean Patent Application No. 2010-000280.
Chinese Office Action dated Apr. 10, 2015 from corresponding Chinese Patent Application No. 201180020953.9.
Australia, Patent Examination Report No. 1, dated May 3, 2013 for corresponding Australian Patent Application No. 2011246522.
Australia, Patent Examination Report No. 1, dated Sep. 16, 2015 for corresponding Australian Patent Application No. 2014227494.
Office Action dated Aug. 11, 2017 from corresponding Korean Patent Application No. 10-2017-7017876.
Notice of Opposition against EP 2236664 B1, EP Application No. 09156683.6, dated Jul. 17, 2017 from European Patent Office.
Response to Notice of Opposition Against EP2236664, dated Mar. 2, 2017 submitted to the European Patent Office.
Notice of Opposition against EP 2236664 B1, EP Application No. 09156683.6, dated Sep. 29, 2016 from European Patent Office.
Chinga-Carrasco, "Cellulose fibres, nanofibrils and microfibrils: The morphological sequence of MFC components from a plant physiology and fibre technology point of view." Chinga-Carrasco Nanoscale Research Letters 2011, vol. 6 p. 417.
Klemm et al., "Cellulose: Fascinating Biopolymer and Sustainable Raw Material." Polymer Science, vol. 44, pp. 3358-3393.
Peng et al., "Drying cellulose nanofibrils: in search of a suitable method." Published online: Dec. 2, 2011, Cellulose, DOI 10.1007/s10570-011-9630-z.
International Search Report and Written Opinion dated Jun. 22, 2011 for International Application No. PCT/EP2011/056540, 11 pages.
International Search Report and Written Opinion dated Sep. 3, 2010 for International Application No. PCT/EP2010/054233, 12 pages.
International Search Report and Written Opinion for International Application No. PCT/EP2011/056542, dated May 27, 2011, 9 pages.
International Search Report and Written Opinion for International Application No. PCT/EP2011/056540, dated Jun. 22, 2011, 10 pages.
Product information for the Ultra-fine Friction Grinder "Supermasscolloider," 1 page, retrieved from http:www.masuko.com/English/product/Masscolloder.html (2014).
Provision of the minutes in accordance with Rule 124(4) EPC dated Nov. 2, 2017, of the oral proceedings for corresponding European Patent No. EP2236664, 5 pages.
Hamann, Lutzm Papiertechnische Stiftung, SUNPAP Workshop May 10, 2011, Seventh Framework Programme, 24 pages.
"Paper Coating Pigments," TAPPI Monograph Series No. 30, 1966, pp. 34-35.
Response to Notice of Opposition Against EP2236664, dated Mar. 2, 2017, submitted to the European Patent Office, 9 pages.
Russian Office Action dated Jan. 21, 2014 for Russian Patent Application No. 2011143854, 7 pages.
Russian Official Action dated Apr. 22, 2015 for Russian Patent Application No. 2015109771, 4 pages.
Samir et al., "Review of Recent Research into Cellulosic Whiskers, Their Properties and Their Application in Nanocomposite Field," Biomacromolecules (2005) 6, pp. 612-626.
Saito et al., "Cellulose Nanofibers Prepared by TEMPO-Mediated Oxidation of Native Cellulose," Biomacromolecules, (2007) 8:2485-2491.
Non-Final Office Action dated Dec. 28, 2017 for U.S. Appl. No. 13/640,513, 9 pages.
Siró, Istvá, "Microfibrillated Cellulose and New Nanocomposite Materials: A Review," Cellulose (2010) 17:459-494.
Siqueira et al., "Cellulosic Bionanocomposites: A Review of Preparation, Properties and Applications," Polymers (2010) 2, pp. 728-765, doi: 10.3390/polym2040728.
Summons to Attend Oral Proceedings Pursuant to Rule 115(1) EPC dated Mar. 22, 2017 for corresponding European Patent No. EP2236664, 10 pages.
Syverud and Stenius, "Strength and Barrier Properties of MFC Films," Cellulose 16:75-85 (2009).
Roberts, J.C., "Chapter 2, The Material of Paper," The Chemistry of Paper, RSC Paperbacks, 1996, pp. 11-25.
Roberts, J.C., "Chapter 4, The Material of Paper," The Chemistry of Paper, RSC Paperbacks, 1996, pp. 52-68.
Taiwan Examination and Search Report dated Apr. 29, 2016 for Taiwan Patent Application No. 100114616, 11 pages.
Taiwan Examination Report and Search Report for Taiwan Patent Application No. 099109560 dated Jun. 22, 2015, 12 pages.
Taiwan Reasons for Rejection dated Apr. 26, 2017 for Taiwanese Application No. 099109562, 5 pages.
Statement of Grounds of Appeal for European Patent No. 2236664 dated Mar. 12, 2018, 13 pages.
Issue Notification dated Oct. 8, 2014 for U.S. Appl. No. 13/138,646, 1 page.
Issue Fee Payment dated Sep. 17, 2014 for U.S. Appl. No. 13/138,646, 5 pages.
Notice of Allowance dated Sep. 16, 2014 for U.S. Appl. No. 13/138,646, 7 pages.
Notice of Allowance dated May 27, 2014 for U.S. Appl. No. 13/138,646, 8 pages.
Final Office Action dated Jan. 27, 2014 for U.S. Appl. No. 13/138,646, 14 pages.
Non-Final Office Action dated Sep. 11, 2013 for U.S. Appl. No. 13/138,646, 13 pages.
Final Office Action dated May 8, 2013 for U.S. Appl. No. 13/138,646, 11 pages.
Non-Final Office Action dated Jan. 15, 2013 for U.S. Appl. No. 13/138,646, 16 pages.
Final Office Action dated Jul. 20, 2017 for U.S. Appl. No. 14/474,749, 12 pages.
Non-Final Office Action dated Dec. 19, 2016 for U.S. Appl. No. 14/474,749, 12 pages.
Final Office Action dated May 9, 2016 for U.S. Appl. No. 14/474,749, 10 pages.
Non-Final Office Action dated Dec. 3, 2015 for U.S. Appl. No. 14/474,749, 11 pages.
Notice of Allowance dated Feb. 23, 2018 for U.S. Appl. No. 14/474,749, 9 pages.
Issue Notification dated Oct. 28, 2014 for U.S. Appl. No. 13/138,647, 1 page.
Issue Fee Payment dated Sep. 11, 2014 for U.S. Appl. No. 13/138,647, 5 pages.
Notice of Allowance dated Sep. 5, 2014 for U.S. Appl. No. 13/138,647, 7 pages.
Notice of Allowance dated May 23, 2014 for U.S. Appl. No. 13/138,647, 8 pages.
Final Office Action dated Jan. 28, 2014 for U.S. Appl. No. 13/138,647, 18 pages.
Non-Final Office Action dated Sep. 11, 2013 for U.S. Appl. No. 13/138,647, 17 pages.
Final Office Action dated May 9, 2013 for U.S. Appl. No. 13/138,647, 15 pages.
Non-Final Office Action dated Jan. 22, 2013 for U.S. Appl. No. 13/138,647, 19 pages.
Final Office Action dated Aug. 4, 2017 for U.S. Appl. No. 14/474,705, 14 pages.
Non-Final Office Action dated Feb. 10, 2017 for U.S. Appl. No. 14/474,705, 15 pages.
Final Office Action dated May 6, 2016 for U.S. Appl. No. 14/474,705, 11 pages.
Non-Final Office Action dated Dec. 3, 2015 for U.S. Appl. No. 14/474,705, 13 pages.

(56) References Cited

OTHER PUBLICATIONS

Final Office Action dated Jan. 12, 2017 for U.S. Appl. No. 13/640,513, 10 pages.
Non-Final Office Action dated Mar. 11, 2016 for U.S. Appl. No. 13/640,513, 8 pages.
Final Office Action dated Nov. 18, 2015 for U.S. Appl. No. 13/640,513, 8 pages.
Non-Final Office Action dated May 15, 2015 for U.S. Appl. No. 13/640,513, 13 pages.
Non-Final Office Action dated Nov. 10, 2014 for U.S. Appl. No. 13/640,513, 12 pages.
Japanese Office Action dated Nov. 7, 2017 for Japanese Patent Application No. 2016-234040, 11 pages.
Selder, H.; Mannes, W., and Matzke, W., "Broke systems for LWC, MWC and HWC Papers", Voith Sulzer Paper Technology, 8 pages, Dec. 2011.
Non-Final Office Action dated Mar. 19, 2018 for U.S. Appl. No. 14/474,705, 8 pages.
Ragnar et al., "Pulp," Ullmann's Encyclopedia of Industrial Chemistry, published on-line 2000, 89 pages.
Ahola et al., "Model Films from Native Cellulose Nanofibrils. Preparation, Swelling, and Surface Interactions," Biomacromolecules, 9: 2008 pp. 1273-1282.
Canadian Office Action for Canadian Patent Application No. 2755493, dated May 28, 2014, 4 pages.
Canadian Office Action for Canadian Patent Application No. 2755493, dated Feb. 19, 2015, 3 pages.
Chinese Office Action for Chinese Patent Application No. 201080015262.5 dated Jul. 9, 2013, 6 pages.
Chinese Office Action for corresponding Chinese Patent Application No. 201610882363.1, dated Jan. 25, 2018, 27 pages.
Chinga-Carrasco, "Cellulose fibres, nanofibrils and microfibrils: The morphological sequence of MFC components from a plant physiology and fibre technology point of view." Chinga-Carrasco Nanoscale Research Letters 2011, vol. 6:417, 8 pages.
Crofton et al., " Dielectric Studies of Cellulose and Its Derivatives: 1. Acetylation of Cellulose," Polymer (1982) 23:1605-1608.
Decision Revoking European Patent No. 2236664 dated Nov. 2, 2017, 12 pages.
Eichhorn et al., "Review: current international research into cellulose nanofibres and nanocomposites." Journal of Materials Science, vol. 45, No. 1, 2010, pp. 1-33.
Esau, Katherine, "Chapter 4, Cell Wall," Anatomy of Seed Plants, 2nd Edition, (1977) pp. 43-48.
European Search Report dated Oct. 23, 2014 for European Patent Application No. 14 175 451.5, 6 pages.
Third Party Observations dated Mar. 16, 2015 for European Patent Application No. 14 175 451.5, 6 pages.
European Office Action dated Sep. 20, 2016 for European Patent Application No. 14 175 451.5, 3 pages.
European Office Action for corresponding European Patent Application No. 14175471.3 dated Oct. 6, 2017, 3 pages.
European Partial European Search Report of European Application No. 16163032, Jul. 26, 2016, 3 pages.
European Extended Search Report for European Patent Application No. 14175471.3 dated Oct. 23, 2014, 8 pages.
Non-Final Office Action dated Sep. 6, 2013 for U.S. Appl. No. 13/640,513, 13 pages.
Third Party Observations dated Jun. 6, 2012 for European Patent Application No. 09156683.6, 4 pages.
Third Party Observations dated Mar. 16, 2015 for European Patent Application No. 14175471.3, 6 pages.
Third Party Observations dated Oct. 21, 2011 for European Patent Application No. 09156683.6, 4 pages.
Third Party Written Submission dated Sep. 25, 2017 for corresponding European Patent No. 2236664, 2 pages.
Fahn, A., "Plant Anatomy Fourth Edition," (1990) pp. 32-39.
Fengel et al., "Chapter 4. Cellulose," Wood Chemistry, Ultrastructure, Reactions, (1983) pp. 66-105.
Fengel, D., "Ideas on the Ultrastructure Organization of the Cell Wall Components," J. Polymer Sci.: Part C, No. 36 (1971) pp. 383-392.
Frey-Wyssling and Mühlethaler, "The Fine Structure of Cellulose." Fortschritte der Chemie Organischer Naturstoffe (1951) pp. 1-27.
Habibi et al., "Cellulose Nanocrystals: Chemistry, Self-Assembly, and Applications," Chem. Rev. (2010) 110, pp. 3479-3500.
Herrick et al. "Microfibrillated Cellulose: Morphology and Accessibility," Journal of Applied Polymer Science, Applied Polymer Symposium 37—Proceedings of the Ninth Cellulose Conference II. Symposium on Cellulose and Wood as Future Chemical Feedstocks and Sources of Energy, and General Papers, John Wiley & Sons, Inc., May 24-27, 1982, 11 pages.
Herrick et al., "Microfibrillated, Cellulose: Morphology and Accessibility," Journal of Applied Polymer Science: Applied Polymer Symposium (1983) 37 pp. 797-813.
http://puu.tkk.fi/em/research/research_groups/chemical_pupling_and_wood_refinery/seminar_presentations/43 knuts_100609_1aitoksen_sisainen_seminaariesitys.pdf;Knuts, M.SC. Aaro, "Process installation and optimization to D refine and produce NFC materials." pp. 1-9, 2010.
Hult et al., "Cellulose Fibril Aggregation—An Inherent Property of Kraft Pulps," Polymer 42 (2001) pp. 3309-3314.
Indian Examination Report dated Aug. 24, 2017 for Indian Patent Application No. 2046/MUMNP/2011, 7 pages.
Ioelovich and Figovsky, "Structure and Properties of Nanoparticles Used in Paper Compositions," Mechanics of Composite Materials, vol. 46, No. 4, 2010, pp. 435-442.
Ioelovich, Michael, "Cellulose as a Nanostructured Polymer: A Short Review." BioResources, vol. 3, No. 4, 2008, pp. 1403-1418.
Japanese Office Action for corresponding Japanese Patent Application No. 2014-248634 dated Jan. 9, 2018, 11 pages.
Japanese Office Action for corresponding Japanese Patent Application No. 2014-248634 dated Mar. 10, 2017, 6 pages.
Japanese Office Action dated Apr. 14, 2015 for Japanese Patent Application No. 2012-502647, 7 pages.
Korean Office Action for Korean Patent Application No. 10-2017-7011268 dated Jun. 21, 2017, 5 pages.
Korean Office Action dated Jul. 28, 2016 for Korean Patent Application No. 10-2011-7025315, 7 pages.
Korean Office Action and Notice Requesting Consultation, dated Nov. 25, 2016 for Korean Patent Application No. 10-2011-7025315, 10 pages.
Lavoine et al., "Microfibrillated Cellulose—Its Barrier Properties and Applications in Cellulosic Materials: A Review," Carbohydrate Polymers 90 (2012) pp. 735-764.
Malaysian Substantive Examination Report for Malaysian Patent Application No. PI 2014002508 dated Nov. 30, 2017, 4 pages.
McGinnis and Shafizadeh, "Chapter 1 Cellulose and Hemicellulose," Pulp and Paper: Chemistry and Chemical Technology (1980) pp. 1-38.
McGraw-Hill, "Cell Walls (Plant)," Encyclopedia of Science and Technology, 5th edition, (1982), pp. 737-741.
Notice of Appeal filed Dec. 21, 2017 for corresponding European Patent No. EP2236664, 1 page.
Notice of Opposition dated Dec. 19, 2014 for European Patent No. EP238682, 22 pages.
Notice of Opposition to European Patent No. 2236545 dated May 27, 2015, 19 pages.
Optifiner™ DF Deflakers, "Improved quality through effective deflaking." Stock Preparation and Recycled Fiber Systems, Metso Paper, 4 pages, 2006.
Pöhler, Tiina & Lappalainen, Timo & Tammelin, Tekla & Eronen, Paula & Hiekkataipale, Panu & Vehniäinen, Annikki & M. Koskinen, Timo. (2011). "Influence of fibrillation method on the character of nanofibrillated cellulose (NFC)," 2010 TAPPI International Conference on Nanotechnology for the Forest Product Industry, Dipoli Congress Centre, Espoo, Finland, Sep. 27-29, 2010, 22 pages.
Rowland and Roberts, "The Nature of Accessible Surfaces in the Microstructure of Cotton Cellulose," Journal of Polymer Science: Part A-1, vol. 10, (1972) pp. 2447-2461.
Final Office Action dated Mar. 26, 2014 for U.S. Appl. No. 13/640,513, 14 pages.

(56) References Cited

OTHER PUBLICATIONS

Auad, M. L., et al., "Characterization of nanocellulose-reinforced shape memory polyurethanes," Polymer International, 2008, 57, 651-659. Online Publication Date: Dec. 13, 2007.
Australia, Patent Examination Report No. 1 dated May 14, 2013 from corresponding Australian Patent Application No. 2011246521 filed on Apr. 26, 2011.
Champinhos, Jr. E., "Sustainable plantations of high-yield Eucalyptus trees for production of fiber: the Aracruz case." New Forests, 1999, 17, 129-143.
Canada, Examination Report dated Apr. 28, 2016 from corresponding Canadian Patent Application No. 2,796,132 filed on Apr. 28, 2011.
Canada, Examination Report dated Sep. 2, 2015 from corresponding Canadian Patent Application No. 2,796,132 filed on Apr. 26, 2011.
Canada, Examination Report dated May 11, 2015 from corresponding Canada Patent Application No. 2,755,495.
China, First Office Action dated May 6, 2014 from corresponding Chinese Patent Application No. 201180020949.2 filed on Apr. 26, 2011.
China, Second Office Action dated Mar. 4, 2015 from corresponding Chinese Patent Application No. 201180020949.2 filed on Apr. 26, 2011.
China, First Office Action dated Oct. 23, 2013 from corresponding Chinese Patent Application No. 201080015263.X.
China, Second Office Action dated Jun. 11, 2014 from corresponding Chinese Patent Application No. 201080015263.X.
China, Third Office Action dated Feb. 27, 2015 from corresponding Chinese Patent Application No. 201080015263.X.
China, Fourth Office Action dated Oct. 13, 2015 from corresponding Chinese Patent Application No. 201080015263.X.
China, Fifth Office Action dated Feb. 15, 2016 from corresponding Chinese Patent Application No. 201080015263.X.
Columbia, Office Action dated Jul. 3, 2013 from corresponding Columbia Patent Application No. 11-128.084.
Ducheyne, Paul, et al., eds. Comprehensive biomaterials. vol. 1. Newnes, 2015, p. 409.
Europe, Examination Report dated Oct. 27, 2015 from corresponding European Patent Application No. 14 175 451.5.
Europe, Examination Report dated Oct. 27, 2015 from corresponding European Patent Application No. 14 175 471.3.
Europe, Search Search Report dated Jun. 26, 2009 for European Application No. EP 09156683.6.
Europe, Third Party Observations dated Apr. 19, 2013 for European Application No. EP 10161173.9.
Europe, Examination Report dated May 2, 2016 from corresponding European Patent Application No. 10 713 884.4.
Europe, Examination Report dated Sep. 16, 2016 from corresponding European Patent Application No. 14 175 471.3.
Europe, Office Action dated Aug. 6, 2013 for corresponding European Patent Application No. 11716257.
Europe, Third Party Observations dated Apr. 12, 2013 for European Application No. EP 10161166.3.
Europe, Third Party Observations dated Apr. 12, 2013 for European Application No. 10161173.9.
Europe, Third Party Observations dated Jan. 9, 2012 for European Application No. EP 10161166.3.
Europe, Search Report dated Jun. 26, 2009 for European Application No. 09156703.2.
Europe, Second Office Action dated Mar. 29, 2016 from corresponding European Patent Application No. 11 719 499.3 filed on Apr. 26, 2011.
Europe, Third Party Observations dated May 18, 2011 for European Application No. 09156683.6.
Europe, Third Party Observations dated Oct. 21, 2011 for European Application No. EP 09156703.2.
Europe, Notice of Opposition dated Dec. 19, 2014 for European Patent No. EP2386682.
Falini, G., et al., "Oriented of Vaterite in Collagenous Matrices," Chem. Eur. J., 1998, 4, 1048-1052.
Indonesia, Office Action dated Mar. 10, 2016 from corresponding Indonesian Patent Application No. W00201103469.
Indonesia, Examination Report dated Oct. 13, 2015 from corresponding Indonesia Patent Application No. W-00 2011 03474.
Japan, Office Action dated Oct. 20, 2015 from corresponding Japan Patent No. 2012-502647.
Japan, Office Action dated Apr. 15, 2014 from corresponding Japan Patent No. 2012-502647.
Japan, Office Action dated Nov. 29, 2016 from corresponding Japan Patent Application No. 2015-159928.
Japan, Official Action dated Oct. 27, 2015 from corresponding Japanese Patent Application No. 2013-506620 filed on Apr. 26, 2011.
Japan, Notice of Rejectoin dated Mar. 31, 2015 from corresponding Japanese Patent Application No. 2013-506620 filed on Apr. 26, 2011.
Japan, Office Action dated Jan. 28, 2014 for Japanese Patent Application No. 2012-502646.
Japan, Office Action dated Dec. 8, 2015 from corresponding Japanese Patent Application No. 2014-248634.
Kenny et al. "Lime and Limestone." Ullmann's Encyclopedia of Industrial Chemistry 2012, vol. 21, 37-69.
Kumar et al. "Comparison of nano-and microfibtillated cellulose films." Cellulose (2014) 21: 3443-3456.
Korea, Office Action dated Feb. 20, 2017 from corresponding Korea Patent Application No. 10-2016-7030178.
Korea, Office Action dated Jan. 27, 2016 from corresponding Korea Patent Application No. 10-2011-7025315.
Korea, Office Action dated Jul. 29, 2016 from corresponding Korean Patent Application No. 10-2012-7030744 filed on Apr. 26, 2011.
Korea, Office Action dated Mar. 28, 2016 from corresponding Korean Patent Application No. 10-2011-7025318.
Malaysia, Examination Report dated Oct. 15, 2015 from corresponding Malaysian Patent Application No. PI 2012004747 filed on Apr. 26, 2011.

* cited by examiner

PROCESS FOR THE MANUFACTURE OF STRUCTURED MATERIALS USING NANO-FIBRILLAR CELLULOSE GELS

CROSS-REFERENCE TO RELATED APPLICATIONS

This application is a U.S. national phase of PCT Application No. PCT/EP2011/056542, filed Apr. 26, 2011, which claims priority to European Application No. 10161166.3, filed Apr. 27, 2010 and U.S. Provisional Application No. 61/343,775, filed May 4, 2010.

FIELD OF THE INVENTION

The present invention relates to a process for the production of structured materials as well as the structured materials obtained by this process.

BACKGROUND OF THE INVENTION

In many technical fields, mixtures of materials are used in order to control or improve certain properties of a product. Such material blends may be, e.g. in the form of loose mixtures, or in the form of composite structures.

A composite material is basically a combination of two or more materials, each of which retains its own distinctive properties. The resulting material has characteristics that are not characteristic of the components in isolation. Most commonly, composite materials have a bulk phase, which is continuous, called the matrix; and a dispersed, non-continuous, phase called the reinforcement. Some other examples of basic composites include concrete (cement mixed with sand and aggregate), reinforced concrete (steel rebar in concrete), and fibreglass (glass strands in a resin matrix).

The following are some of the reasons why composites are selected for certain applications:

- High strength to weight ratio (low density high tensile strength)
- High creep resistance
- High tensile strength at elevated temperatures
- High toughness Typically, reinforcing materials are strong, while the matrix is usually a ductile, or tough, material. If the composite is designed and fabricated correctly, it combines the strength of the reinforcement with the toughness of the matrix to achieve a combination of desirable properties not available in any single conventional material. For example: polymer/ceramic composites have a greater modulus than the polymer component, but are not as brittle as ceramics.

Since the reinforcement material is of primary importance in the strengthening mechanism of a composite, it is convenient to classify composites according to the characteristics of the reinforcement. The following three categories are commonly used:

a) "fibre reinforced", wherein the fibre is the primary load-bearing component.
b) "particle reinforced", wherein the load is shared by the matrix and the particles.
c) "dispersion strengthened", wherein the matrix is the major load-bearing component.
d) "structural composites", wherein the properties depend on the constituents, and the geometrical design.

Generally, the strength of the composite depends primarily on the amount, arrangement and type of fibre (or particle) reinforcement in the resin. In addition, the composite is often formulated with fillers and additives that change processing or performance parameters.

Thus, in the prior art, it is generally known to combine different materials in order to obtain materials having modified properties or being able to control certain properties of a material to which they are applied, and there is a continuous need for such materials allowing for the tailor-made control of material characteristics, as well as regarding their cost-efficiency and environmental compliance.

An important field in this respect is the production of structured material and their properties.

One example of structured materials is paper, in the manufacture of which a number of different materials are combined, each of which can positively or negatively influence the properties of the other components, or the final paper.

One of the most common groups of additives in the field of paper manufacturing and finishing are fillers having several advantageous functions in paper. For example, fillers are used for reasons of opacity or the provision of a smoother surface by filling the voids between the fibres.

There are, however, limitations with respect to the amount of fillers, which can be added to the paper, as increasing filler amounts in conventional paper leads to an inverse relationship between the strength and optical properties.

Thus, conventional paper may contain a certain amount of fillers, but if the filler content is too high, the mechanical properties of the paper will significantly decrease.

Several approaches have been proposed to improve this relationship and to produce a highly filled paper having good optical as well as mechanical properties, but there is still a need for processes for manufacturing paper allowing for a higher filler content as commonly used without essentially impairing the paper strength.

Searching for methods for controlling the properties of structured materials or of products containing such structured materials, it was found that special nano-fibrillar cellulosic gels comprising calcium carbonate can be useful.

Cellulose is the structural component of the primary cell wall of green plants and is the most common organic compound on Earth. It is of high interest in many applications and industries.

Cellulose pulp as a raw material is processed out of wood or stems of plants such as hemp, linen and manila. Pulp fibres are built up mainly by cellulose and other organic components (hemicellulose and lignin). The cellulose macromolecules (composed of 1-4 glycosidic linked β-D-Glucose molecules) are linked together by hydrogen bonds to form a so called primary fibril (micelle) which has crystalline and amorphous domains. Several primary fibrils (around 55) form a so called microfibril. Around 250 of these microfibrils form a fibril.

The fibrils are arranged in different layers (which can contain lignin and/or hemicellulose) to form a fibre. The individual fibres are bound together by lignin as well.

When fibres become refined under applied energy they become fibrillated as the cell walls are broken and torn into attached strips, i.e. into fibrils. If this breakage is continued to separate the fibrils from the body of the fibre, it releases the fibrils. The breakdown of fibres into microfibrils is referred to as "microfibrillation". This process may be continued until there are no fibres left and only fibrils of nano size (thickness) remain.

If the process goes further and breaks these fibrils down into smaller and smaller fibrils, they eventually become cellulose fragments or nano-fibrillar gels. Depending on how far this last step is taken some nano-fibrils may remain amongst the nano-fibrillar gels. The breakdown to primary fibrils may be referred to as "nano-fibrillation", where there may be a smooth transition between the two regimes. The primary fibrils form in an aqueous environment a gel (meta stable network of primary fibrils) which may be referred to as "nano-fibrillar gel". The gel formed from the nano-fibrils can be considered to contain nanocellulose.

Nano-fibrillar gels are desirable as they usually contain very fine fibrils, considered to be constituted in part of nanocellulose, showing a stronger binding potential to themselves, or to any other material present, than do fibrils which are not so fine or do not exhibit nanocellulosic structure.

From unpublished European patent application No. 09 156 703.2, nano-fibrillar cellulose gels are known. However, there is no teaching with respect to their effects in structured materials.

SUMMARY OF THE INVENTION

It has now been found that such nano-fibrillar cellulose gels can be useful in the production and control, especially of the mechanical properties, of structured materials.

Thus, the above problem is solved by a process for manufacturing structured materials, which is characterized by the following steps:

a) providing cellulose fibres;
b) providing at least one filler and/or pigment;
c) combining the cellulose fibres of step a) and the at least one filler and/or pigment of step b);
d) fibrillating the cellulose fibres in the presence of the at least one filler and/or pigment until a gel is formed;
e) providing additional non-fibrillated fibres;
f) combining the gel of step d) with the fibres of step e).

Nano-fibrillar cellulose in the context of the present invention means fibres, which are at least partially broken down to primary fibrils. If these primary fibrils are in an aqueous environment, a gel (meta stable network of primary fibrils considered in the limit of fineness to be essentially nanocellulose) is formed, which is designated as "nano-fibrillar gel", wherein there is a smooth transition between nano fibres and nano-fibrillar gel, comprising nano-fibrillar gels containing a varying extent of nano-fibrils, all of which are comprised by the term nano-fibrillar cellulose gels according to the present invention.

In this respect, fibrillating in the context of the present invention means any process which predominantly breaks down the fibres and fibrils along their long axis resulting in the decrease of the diameter of the fibres and fibrils, respectively.

DETAILED DESCRIPTION OF THE INVENTION

Figure 1:
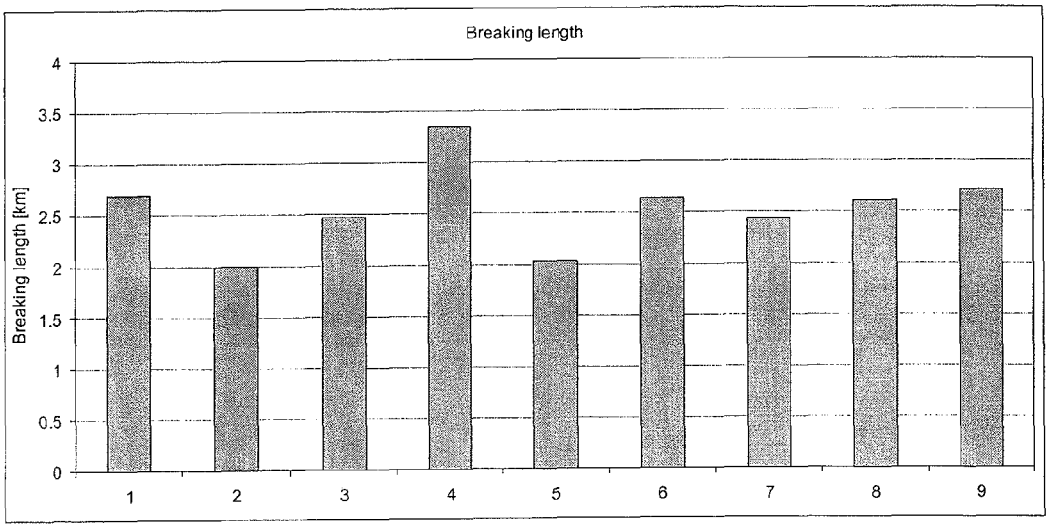
FIG. 1 shows a comparison of handsheets of the prior art and according to the invention containing GCC as a filler with respect to breaking lengths.
Figure 2:
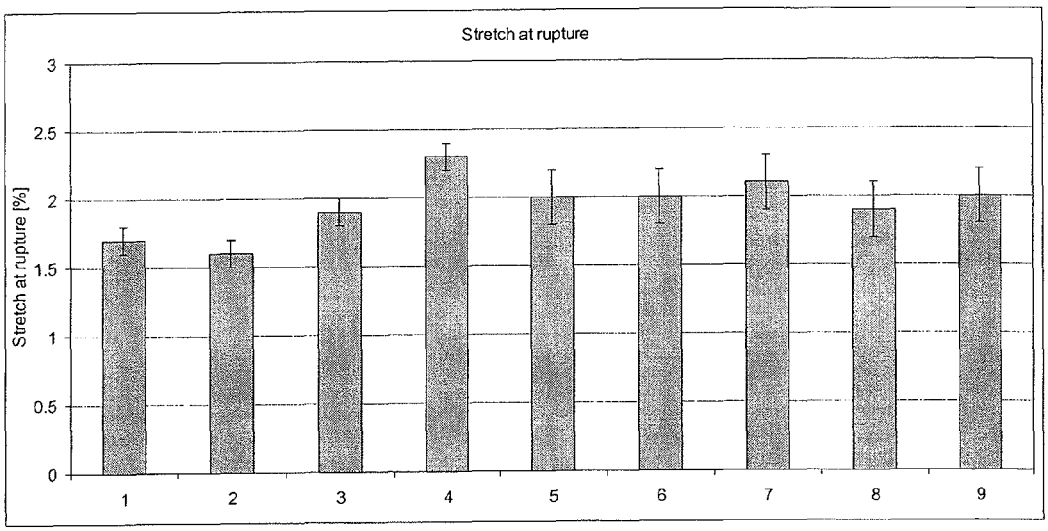
FIG. 2 shows a comparison of handsheets of the prior art and according to the invention containing GCC as a filler with respect to stretch at rupture.
Figure 3:
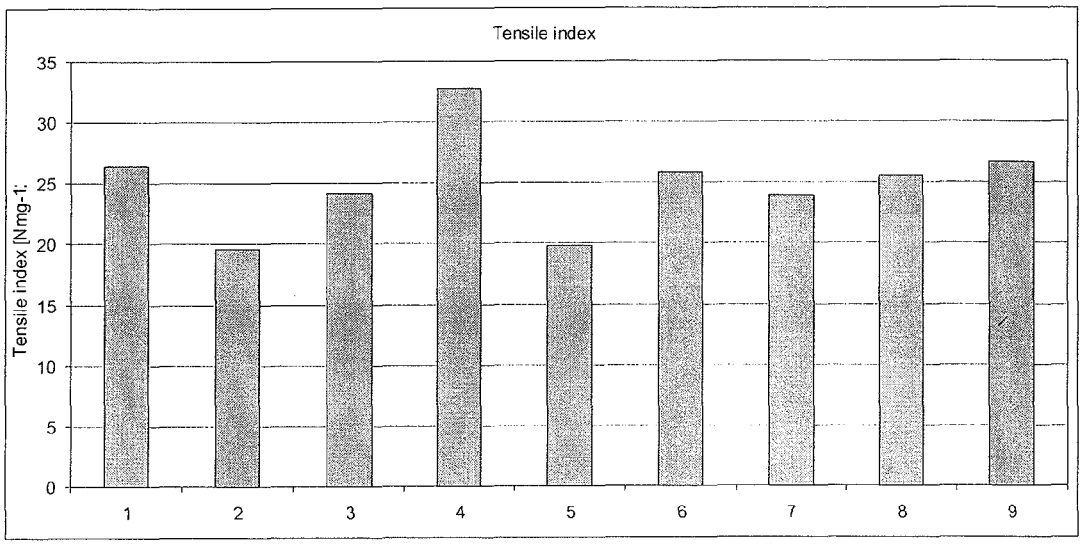
FIG. 3 shows a comparison of handsheets of the prior art and according to the invention containing GCC as a filler with respect to tensile index.
Figure 4:
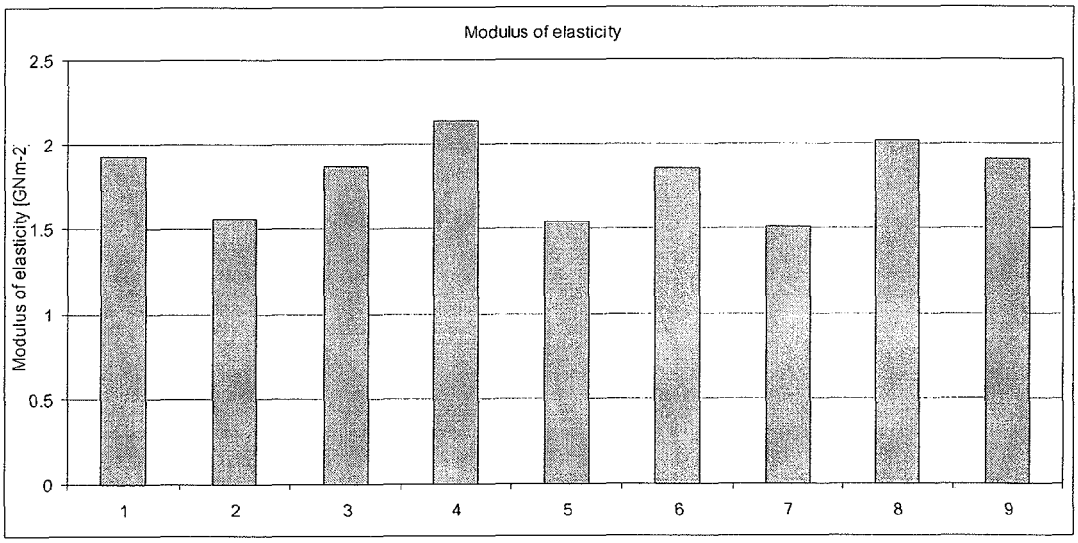
FIG. 4 shows a comparison of handsheets of the prior art and according to the invention containing GCC as a filler with respect to modulus of elasticity.
Figure 5:
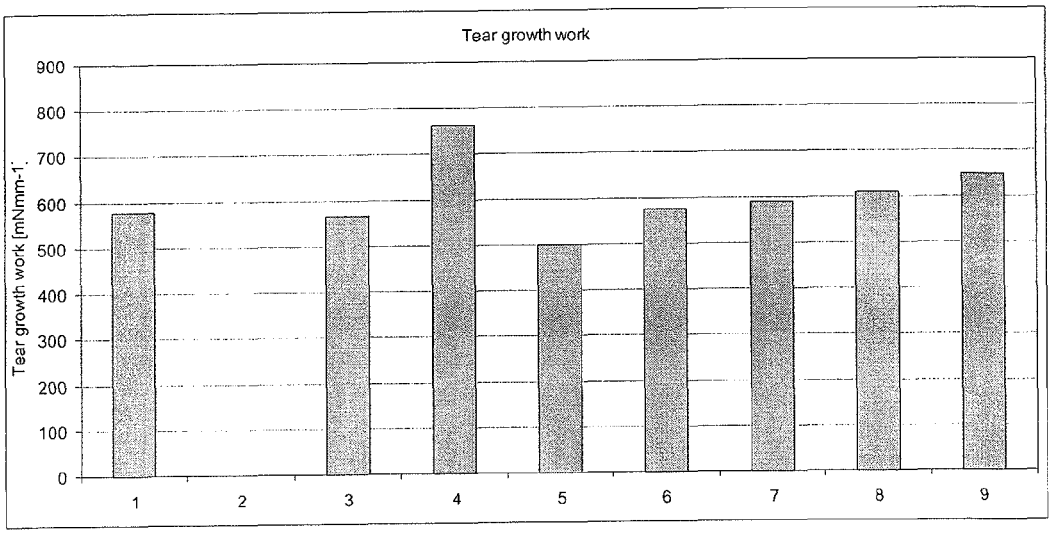
FIG. 5 shows a comparison of handsheets of the prior art and according to the invention containing GCC as a filler with respect to tear growth length.
Figure 6:
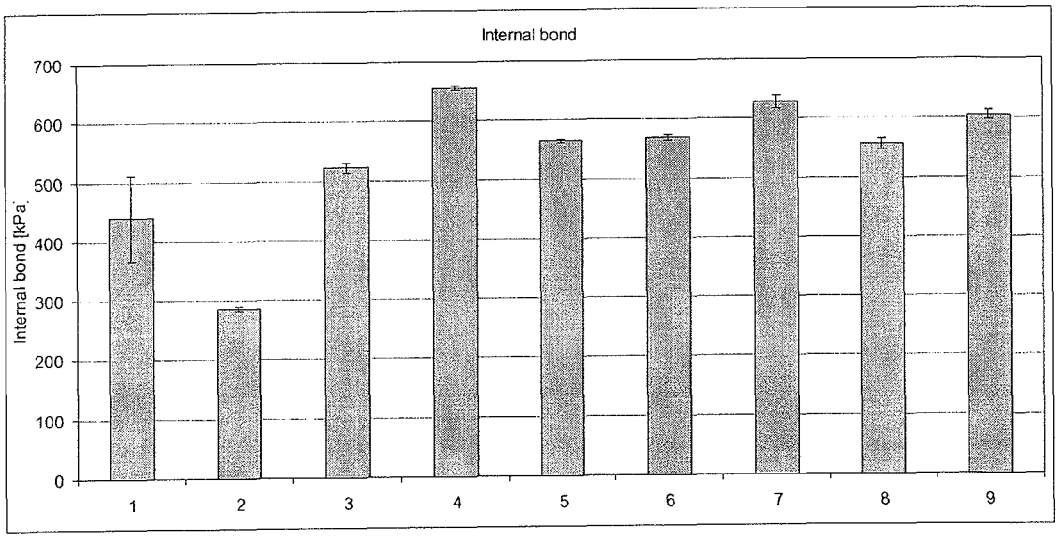
FIG. 6 shows a comparison of handsheets of the prior art and according to the invention containing GCC as a filler with respect to internal bond.

According to the process of the present invention, the fibrillation of cellulose fibres in the presence of at least one filler and/or pigment provides a nano-fibrillar cellulose gel. The fibrillation is performed until the gel is formed, wherein the formation of the gel is verified by the monitoring of the viscosity in dependence of the shearing rate. Upon step-wise increase of the shearing rate a certain curve reflecting a decrease of the viscosity is obtained. If, subsequently the shearing rate is step-wise reduced, the viscosity increases again, but the corresponding values over at least part of the shear rate range as shearing approaches zero are lower than when increasing the shearing rate, graphically expressed by a hysteresis manifest when the viscosity is plotted against the shearing rate. As soon as this behaviour is observed, a nano-fibrillar cellulose gel according to the present invention is formed. Further details with respect to the production of the nano-fibrillar cellulose gel can be taken from unpublished European patent application No. 09 156 703.

Cellulose fibres, which can be used in the process of the present invention may be such contained in natural, chemical, mechanical, chemimechanical, thermomechanical pulps. Especially useful are pulps selected from the group comprising eucalyptus pulp, spruce pulp, pine pulp, beech pulp, hemp pulp, cotton pulp, bamboo pulp, bagasse and mixtures thereof. In one embodiment, all or part of this cellulose fibre may be issued from a step of recycling a material comprising cellulose fibres. Thus, the pulp may also be recycled and/or deinked pulp.

The size of the cellulose fibres in principle is not critical. Useful in the present invention generally are any fibres commercially available and processable in the device used for their fibrillation. Depending on their origin, cellulose fibres may have a length of from 50 mm to 0.1 μm. Such fibres, as well as such having a length of preferably 20 mm to 0.5 μm, more preferably from 10 mm to 1 mm, and typically from 2 to 5 mm, can be advantageously used in the present invention, wherein also longer and shorter fibres may be useful.

It is advantageous for the use in the present invention that the cellulose fibres of step a) are provided in the form of a suspension, especially an aqueous suspension. Preferably, such suspensions have a solids content of from 0.2 to 35 wt %, more preferably 0.25 to 10 wt %, even more preferably 0.5 to 5 wt %, especially 1 to 4 wt %, most preferably 1.3 to 3 wt %, e.g. 1.5 wt %.

The additional non-fibrillated fibres of step e) preferably are selected from cellulose fibres as defined above, as well. However, also other fibre materials may be advantageously used as additional non-fibrillated fibres in the process of the process of the present invention.

The at least one filler and/or pigment is selected from the group comprising precipitated calcium carbonate (PCC); natural ground calcium carbonate (GCC); surface modified calcium carbonate; dolomite; talc; bentonite; clay; magnesite; satinwhite; sepiolite, huntite, diatomite; silicates; and mixtures thereof. Precipitated calcium carbonate, which may have vateritic, calcitic or aragonitic crystal structure, and/or natural ground calcium carbonate, which may be selected from marble, limestone and/or chalk, are especially preferred.

In a special embodiment, the use of ultrafine discrete prismatic, scalenohedral or rhombohedral precipitated calcium carbonate may be advantageous.

The filler(s) and/or pigment(s) can be provided in the form of a powder, although they are preferably added in the form of a suspension, such as an aqueous suspension. In this case, the solids content of the suspension is not critical as long as it is a pumpable liquid.

In a preferred embodiment, filler and/or pigment particles of step b) have a median particle size of from 0.01 to 15 μm, preferably 0.1 to 10 μm, more preferably 0.3 to 5 μm, especially from 0.5 to 4 μm and most preferably 0.7 to 3.2 μm, e.g. 2 μm. For the determination of the weight median particle size $d_{50}$, for particles having a $d_{50}$ greater than 0.5 μm, a Sedigraph 5100 device from the company Micromeritics, USA was used. The measurement was performed in an aqueous solution of 0.1 wt-% $Na_4P_2O_7$. The samples were dispersed using a high-speed stirrer and ultrasound. For the determination of the volume median particle size for particles having a $d_{50} \leq 500$ nm, a Malvern Zetasizer Nano ZS from the company Malvern, UK was used. The measurement was performed in an aqueous solution of 0.1 wt % $Na_4P_2O_7$. The samples were dispersed using a high-speed stirrer and ultrasound.

In view of the advantageous effect of the addition of nano-fibrillar cellulosic gels with respect to mechanical paper properties even at high pigment and/or filler contents, in an especially preferred embodiment, before, during or after the addition of further fibres in step e), but after step d) and before step f), at least one further filler and/or pigment is added.

This at least one further filler and/or pigment may be the same or a different filler and/or pigment of step b) selected from the group comprising precipitated calcium carbonate (PCC); natural ground calcium carbonate (GCC); surface modified calcium carbonate; dolomite; talc; bentonite; clay; magnesite; satin white; sepiolite, huntite, diatomite; silicates; and mixtures thereof. Precipitated calcium carbonate, which may have vateritic, calcitic or aragonitic crystal structure, and/or natural ground calcium carbonate, which may be selected from marble, limestone and/or chalk, are especially preferred.

In a special embodiment, the use of ultrafine discrete prismatic, scalenohedral or rhombohedral precipitated calcium carbonate may be advantageous.

Also these additional filler(s) and/or pigment(s) can be provided in the form of a powder, although they are preferably added in the form of a suspension, such as an aqueous suspension. In this case, the solids content of the suspension is not critical as long as it is a pumpable liquid.

It has however turned out especially advantageous, if the at least one further filler and/or pigment is a rather fine product in terms of the particle size, and especially preferably comprises at least a fraction of particles having a median diameter $d_{50}$ in the nanometer range, contrary to the pigment(s) and/or filler(s) used in the gel formation, which are rather coarse ones.

Thus, it is furthermore preferred that the at least one further filler and/or pigment particles have a median particle size of from 0.01 to 5 μm, preferably 0.05 to 1.5 μm, more preferably 0.1 to 0.8 μm and most preferably 0.2 to 0.5 μm, e.g. 0.3 μm, wherein the particle size is determined as mentioned above.

Any one of the fillers and/or pigments used in the present invention may be associated with dispersing agents such as those selected from the group comprising homopolymers or copolymers of polycarboxylic acids and/or their salts or derivatives such as esters based on, e.g., acrylic acid, methacrylic acid, maleic acid, fumaric acid, itaconic acid, e.g. acryl amide or acrylic esters such as methylmethacrylate, or mixtures thereof; alkali polyphosphates, phosphonic-, citric- and tartaric acids and the salts or esters thereof; or mixtures thereof.

The combination of fibres and at least one filler and/or pigment of step b) can be carried out by adding the filler and/or pigment to the fibres in one or several steps. As well, the fibres can be added to the filler and/or pigment in one or several steps. The filler(s) and/or pigment(s) of step b) as well as the fibres of step a) can be added entirely or in portions before or during the fibrillating step. However, the addition before fibrillation is preferred.

During the fibrillation process, the size of the filler(s) and/or pigment(s) as well as the size of the fibres can change.

Preferably, the weight ratio of fibres to filler(s) and/or pigment(s) of step b) on a dry weight basis is from 1:33 to 10:1, more preferably 1:10 to 7:1, even more preferably 1:5 to 5:1, typically 1:3 to 3:1, especially 1:2 to 2:1 and most preferably 1:1.5 to 1.5:1, e.g. 1:1.

The dosage of filler and/or pigment in step b) may be critical. If there is too much of the filler and/or pigment, this may influence the formation of the gel. Thus, if no gel formation is observed in specific combination, it might be necessary to reduce the amount of filler and/or pigment.

Furthermore, in one embodiment, the combination is stored for 2 to 12 hours, preferably 3 to 10 hours, more preferably 4 to 8 hours, e.g. 6 hours, prior to fibrillating it, as this ideally results in swelling of the fibres facilitating the fibrillation.

Fibre swelling may be facilitated by storage at increased pH, as well as by addition of cellulose solvents like e.g. copper(II)ethylenediamine, iron-sodium-tartrate or lithium-chlorine/dimethylacetamine, or by any other method known in the art.

Fibrillating is carried out by means of any device useful therefore. Preferably the device is a homogenizer. It may also be an ultra fine friction grinder such as a Supermass-colloider from Masuko Sangyo Co. Ltd, Japan or one as described in U.S. Pat. No. 6,214,163 or U.S. Pat. No. 6,183,596.

Suitable for the use in the present invention are any commercially available homogenizers, especially high pressure homogenizers, wherein the suspensions are pressed under high pressure through a restricted opening, which may comprise a valve, and are discharged from the restricted opening at high pressure against a hard impact surface directly in front of the restricted opening, thus reducing the particle size. The pressure may be generated by a pump such as a piston pump, and the impact surface may comprise an impact ring extending around the annular valve opening. An example for an homogenizer, which can be used in the present invention is Ariete NS2006L of GEA Niro Soavi. However, inter alia, also homogenizers such as of the APV Gaulin Series, HST HL Series or the Alfa Laval SHL Series can be used.

Furthermore, devices such as ultra-fine friction grinders, e.g. a Supermasscolloider, can be advantageously used in the present invention.

The structured material can be produced by mixing the nano-fibrillar cellulosic gel and additional non-fibrillated fibres, as well as, optionally, further filler and/or pigment, and subsequently dewatering the combination to form a base structure such as e.g. a base paper sheet.

In this respect, generally any commonly used method of dewatering known to the person skilled in the art, may be used, such as e.g. heat drying, pressure drying, vacuum drying, freeze drying, or drying under supercritical conditions. The dewatering step may be carried out in well-known devices such as in a filter press, e.g. as described in the Examples. Generally, other methods that are well known in the field of moulding of aqueous systems can be applied to obtain the inventive composites.

In a special embodiment, the additional non-fibrillated fibres may be provided in the form of a preformed fibre structure such as a fibre web and to combine this structure with the gel, as well as, optionally, with further filler and/or pigment, resulting in the at least partial coating of the fibre structure by the gel.

Generally, the structured material, as well as any layers of fibre structure, e.g. fibre web and gel, in this respect can have varying thicknesses.

By varying the thickness of the structured materials, and, optionally, of the different layers of the resulting structured material allows for the control of the properties of the material as well as of the product to which the material is applied.

Thus, the structured material according to the present invention may be as thin as a film, may have a thickness which is typically found in conventional papers, but also may be as thick as boards, and even may have the form of compact blocks, inter alia depending on the ratio of fibres and gel.

For example, in paper production, it is advantageous that the structured material, and the layers thereof, respectively, are rather thin. Thus, it is preferred that the fibre layer has a thickness of 0.02 mm to 0.23 mm, and one or more gel layers have a thickness of 0.005 mm to 0.15 mm, wherein the total thickness of the structured material is of 0.05 mm to 0.25 mm.

With respect to paper applications, it has been found that the combination of the cellulosic nano-fibrillar gel with the fibres for forming the paper has a considerable influence on the properties of the paper with respect to the filler load.

Thus, it is an especially preferred embodiment that the structured material is a paper.

In this respect, the addition of only a minimal amount of nano-fibrillar cellulosic gel is necessary. The amount of nano-fibrillar cellulosic gel in paper applications expressed by the cellulosic content of the gel in relation to the additional non-fibrillated fibres (dry/dry weight basis) may be about 0.5 to 20 wt %, preferably 1 to 15 wt %, 2 to 10 wt %, 3 to 6 wt %, e.g. 5 wt %.

Thus, it is possible to form a paper sheet comprising the gel in the base paper and/or in a layer coating the fibre web resulting in layered structures of paper-forming fibres and gels.

Papers, which can be manufactured and improved with respect to an increase of the amount of filler by the process of the present invention are papers, which are preferably selected from, but not limited to printing and writing paper, as well as newspapers.

Furthermore, by the process of the present invention it is even possible to introduce filler in tissue paper.

Thus, by the process of the present invention a more efficient use of poor grade fibres is achieved. By the addition of nano-fibrillar cellulosic gel to base furnishes containing fibres deficient in imparting strength to the final fibre-based product, the paper strength can be improved.

Regarding the total content of filler and/or pigment in the paper, it is especially preferred that the filler and/or pigments are present in an amount of from 1 wt % to 60 wt %, preferably from 5 wt % to 50 wt %, more preferably from 10 to 45 wt %, even more preferably from 25 wt % to 40 wt %, especially from 30 to 35 wt % on a dry weight basis of the structured material.

The use of the nano-fibrillar cellulose gels as defined above for the production of structured material is a further aspect of the invention, wherein the gel is combined with additional non-fibrillated fibres and the resulting combination is dewatered.

Another aspect of the present invention is the structured material obtained by the process according to the invention, or by the use of the nano-fibrillar cellulose gels for the production of structured material as mentioned.

Due to their mechanical strength properties the nano-fibrillar cellulose gels can be advantageously used in applications such as in material composites, plastics, paints, rubber, concrete, ceramics, pannels, housings, foils and films, coatings, extrusion profiles, adhesives, food, or in wound-healing applications.

The figures described above, and the examples and experiments, serve to illustrate the present invention and should not restrict it in any way.

EXAMPLES

In the context of the present invention the following terms are used:

- solid content [wt %] meaning the overall solids, i.e. any non-volatile material (here essentially pulp/cellulose and filler)
- cellulosic solid content [wt %] meaning the fraction of cellulosic material on the total mass only, i.e. pulp before fibrillation, or nano-cellulose after fibrillation. The value can be calculated using the overall solids content and the ratio of filler to pulp.
- Addition levels (ratios) of gels in compositions (e.g. hand sheets): Any percentages are to be understood as wt % of the dry cellulosic content (see above) on the total mass of the composition (the hand sheet is 100 wt %)
- Density, thickness and bulk was determined according to ISO 534, Grammage was determined according to ISO 536, Clima control was carried out according to ISO 187:1997.

1. Nano-Fibrillar Cellulosic Gel with Standard GCC Fillers

Material

Filler (gel):

Omyacarb® 1 AV (OC 1 AV) (dry powder)

Omyacarb® 10 AV (OC 10 AV) (dry powder)

Both available from Omya AG; Fine calcium carbonate powder, manufactured from a high purity, white marble; The weight median particle size $d_{50}$ is 1.7 or 10 μm, respectively, measured by Malvern Mastersizer X.

Hydrocarb 60 AV (HC 60 AV) (dispersed product) available from Omya AG: Selected, natural ground calcium carbonate (marble), microcrystalline, rhombrohedral particle shape of high fineness in the form of a pre-dispersed slurry. The weight median particle size $d_{50}$ is 1.6 μm, measured by Sedigraph 5100. Suspension solids=78 wt %.

Pulp (gel):

Dried pine mats, brightness: 88.19%, TCF bleached

Dried Eucalyptus, brightness: 88.77%, TCF bleached

Non dried pine, brightness: 88.00%

Filler (Hand Sheets):

Hydrocarb® HO—ME (dispersed product) available from Omya AG; Selected, natural ground calcium carbonate (marble), microcrystalline, rhombohedral particle shape of high fineness in the form of a pre-dispersed slurry (solids content 62 wt %); The weight median particle size $d_{50}$ is 0.8 μm measured by Sedigraph 5100.

Pulp (Hand Sheets):

80 wt % short fibre (birch)/20 wt % long fibre (pine), freeness: 23° SR (Brightness: 88.53%)

Retention Aid:

Polyimin 1530 (available from BASF)

Gel Formation

The gels were processed with an ultra-fine friction grinder (Supermasscolloider from Masuko Sangyo Co. Ltd, Japan (Model MKCA 6-2) with mounted silicon carbide stones having a grit class of 46 (grit size 297-420 μm). The dynamic 0-point was adjusted as described in the manual delivered by the supplier (the zero point is defined as the touching point of the stones, so there the gap between the stones is 0 mm) The speed of the rotating grinder was set to 1500 rpm.

The suspensions to be fibrillated were prepared as follows: 80 g of the dry mat pulp was torn into pieces of 40×40 mm and 3920 g tap water were added. In the case where wet pulp was used, 800 g of pulp (solids content: 10 wt %) were mixed with 3200 g of tap water.

Each of the suspensions was stirred in a 10 $dm^3$ bucket at 2000 rpm using a dissolver disk with a diameter of 70 mm. The suspensions were stirred for at least 10 minutes at 2000 rpm.

At first, the pulp was disintegrated by passing it two times through the grinder with an open stone gap (0 μm). Subsequently, the stone gap was tightened to −200 μm for fibrillating the pulp in two passages. Filler (according to Table 1) was added to this fibrillated pulp suspension, and this mixture was ground by circulating three times with a stone gap of −300 to −400 μm.

TABLE 1

| Sample | Weight ratio (dry/dry) filler:pulp | Filler | Pulp | Cellulosic solid content [wt %] |
|---|---|---|---|---|
| A | 2:1 | OC 10 AV | Pine, dried | 2 |
| B | 3:1 | OC 10 AV | Pine, dried | 2 |
| C | 3:1 | OC 1 AV | Pine, wet | 2 |
| D | 3:1 | OC 10 AV | Pine, wet | 2 |
| E | 2:1 | HC 60 AV | Pine, dried | 2 |
| F | 10:1 | OC 1 AV | Pine, dried | 2 |

Hand Sheet Formation 60 g dry weight of a paste of wood and fibres composed of 80 wt % birch and 20 wt % pine, with a SR value of 23° and the according amount of the nanocellulosic gel (see table 2) is diluted in 10 $dm^3$ of tap water. The filler (Hydrocarb® HO-ME) is added in an amount so as to obtain the desired overall filler content based on the final paper weight (see table 2). After 15 minutes of agitation and following addition of 0.06% by dry weight, relative to the dry weight of the paper, of a polyacrylamide retention aid, a sheet with a grammage of 80 $g/m^2$ is formed using Rapid-Kothen type hand sheet former. Each sheet was dried using Rapid-Kothen type drier.

The filler content is determined by burning a quarter of a dry hand sheet in a muffle furnace heated to 570° C. After burning is completed, the residue is transferred in a desiccator to cool down. When room temperature is reached, the weight of the residue is measured and the mass is related to the initially measured weight of the dry quarter hand sheet.

TABLE 2

| Hand sheet No. | Base weight [$g/m^2$] | Pulp [wt %, dry/dry] | Ash (total filler content) [wt %] | Gel type (according to table 1) [wt %, dry/dry] A | B | C | D | E | F |
|---|---|---|---|---|---|---|---|---|---|
| 1 (comparative) | 80 | 80 | 20 | | | | | | |
| 2 (comparative) | 80 | 70 | 30 | | | | | | |
| 3 (invention) | 80 | 67 | 30 | 3 | | | | | |
| 4 (invention) | 80 | 64 | 30 | | 6 | | | | |
| 5 (invention) | 80 | 44 | 50 | | 6 | | | | |
| 6 (invention) | 80 | 67 | 30 | | | 3 | | | |
| 7 (invention) | 80 | 41 | 50 | | | | 9 | | |
| 8 (invention) | 80 | 67 | 30 | | | | | 3 | |
| 9 (invention) | 80 | 67 | 30 | | | | | | 3 |

Hand Sheet Testing

Usually, the addition of fillers, while improving the optical properties, has a rather destabilising effect on the mechanical properties of a paper sheet.

However, as can be taken from the following experiments, mechanical properties of a gel containing paper are either comparable or better than those of hand sheets not containing the gel according to the invention, even at higher filler contents, and at the same or better optical properties. Furthermore, the hand sheets have a significantly higher air resistance, which is an advantage with respect to ink penetration and printing.

The hand sheets were tested and characterized as follows:

1. Mechanical Properties

The mechanical properties of the hand sheets according to the invention were characterized by their breaking length, stretch at rupture, tensile index, E-modulus, tear growth work, and internal bond.

Breaking length, stretch at rupture, tensile index, and E-modulus (modulus of elasticity) of the hand sheets were determined by the tensile test according to ISO 1924-2. Tear growth work was determined according to DIN 53115. Internal bond was determined according to SCAN-P80:98/TAPPI T 541 om.

As can be taken from FIGS. 1, 2, 3, 4, 5 and 6, breaking length, stretch at rupture, tensile index, E-modulus, and internal bond values of the comparative hand sheets No. 1 and 2 decrease with increasing filler content.

Looking at the inventive hand sheets, it can be seen that any one of the hand sheets No. 3, 4, 6, 8 and 9 containing 30 wt % filler, but additional gel, have better breaking lengths, stretch at rupture, tensile index, E-modulus, tear growth work, and internal bond properties than comparative hand sheet No. 2.

Even hand sheets No. 5 and 7 containing filler in an amount as high as 50 wt % and gel according to the invention have comparable or better breaking length, stretch at rupture, tensile index, E-modulus, tear growth work, and internal bond properties than the comparative hand sheets having a much lower filler content.

2. Optical Properties

The optical properties of the hand sheets according to the invention were characterized by their opacity, light scattering, and light absorbency.

Opacity of the hand sheets was determined according to DIN 53146. Scattering and absorbency were determined according to DIN 54500.

Figure 7:
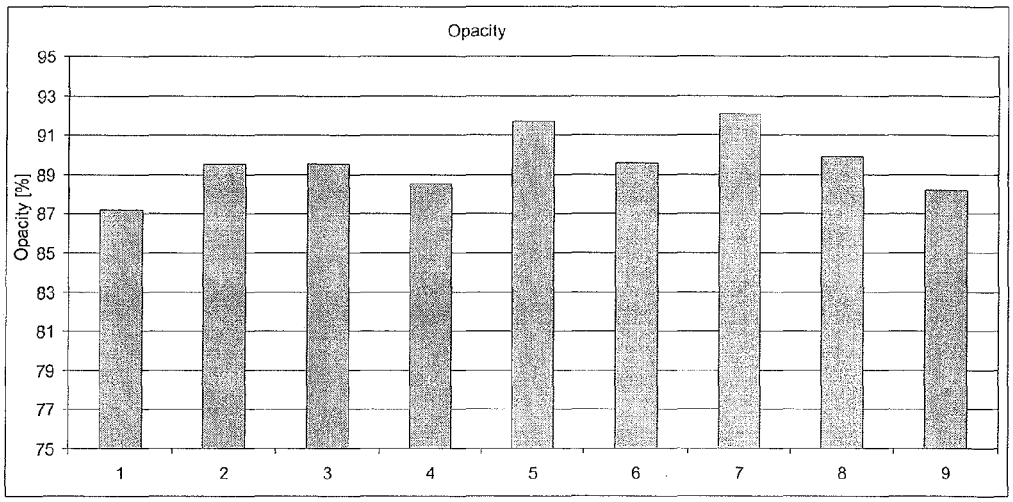
FIG. 7 shows a comparison of handsheets of the prior art and according to the invention containing GCC as a filler with respect to opacity.
Figure 8:
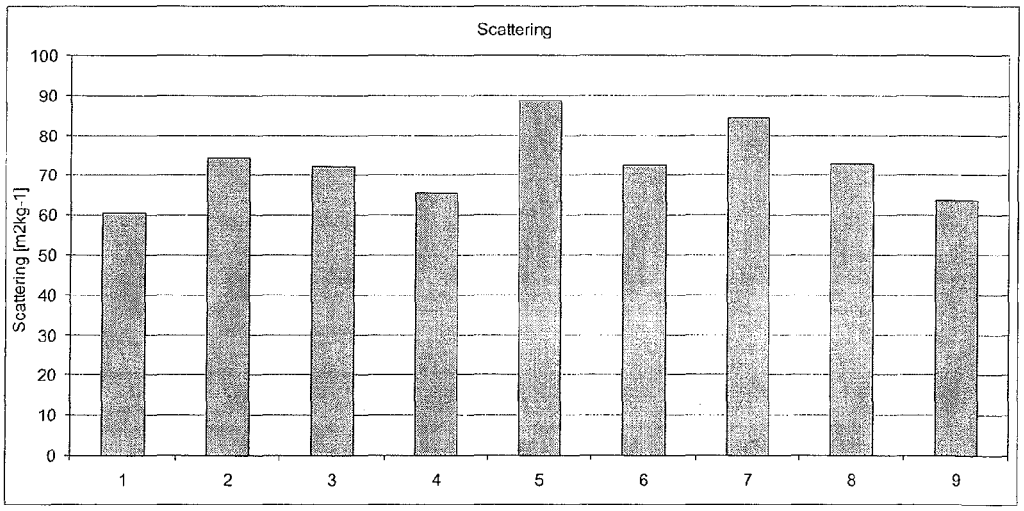
FIG. 8 shows a comparison of handsheets of the prior art and according to the invention containing GCC as a filler with respect to scattering.
Figure 9:
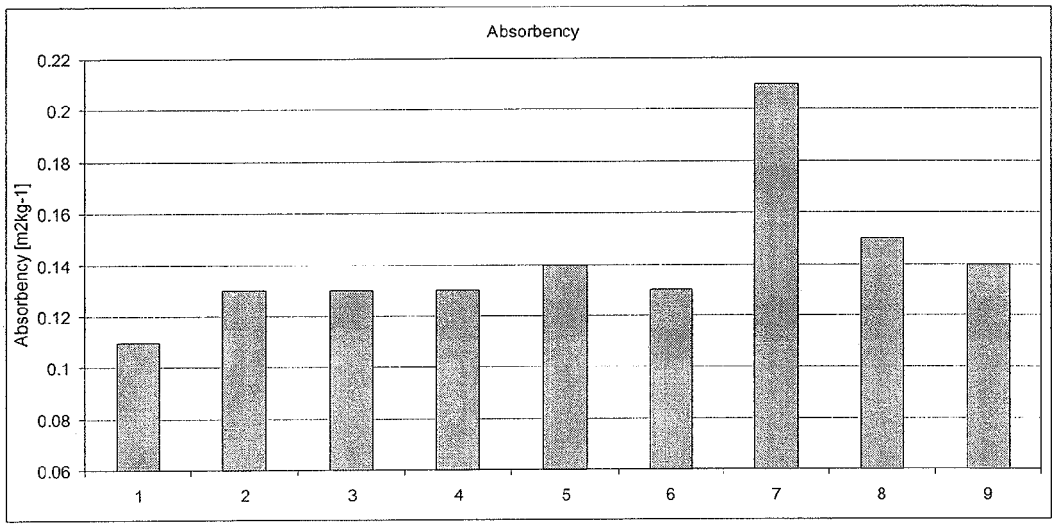
FIG. 9 shows a comparison of handsheets of the prior art and according to the invention containing GCC as a filler with respect to absorbency.

As can be taken from FIGS. 7, 8, and 9, opacity (determined as grammage reduced opacity), light scattering, and light absorbency of comparative hand sheets No. 1 and 2 increase with increasing filler content.

Looking at the inventive hand sheets, it can be seen that any one of the hand sheets No. 3, 4, 6, 8 and 9 containing 30 wt % filler, but additional gel, have comparable or better opacity, light scattering, and light absorbency properties than comparative hand sheet No. 2.

Hand sheets No. 5 and 7 containing filler in an amount as high as 50 wt % and gel according to the invention have better opacity, light scattering, and light absorbency properties than the comparative hand sheets having a lower filler content.

3. Air Resistance

The air resistance was determined according to ISO 5636-1/-3.

Figure 10:
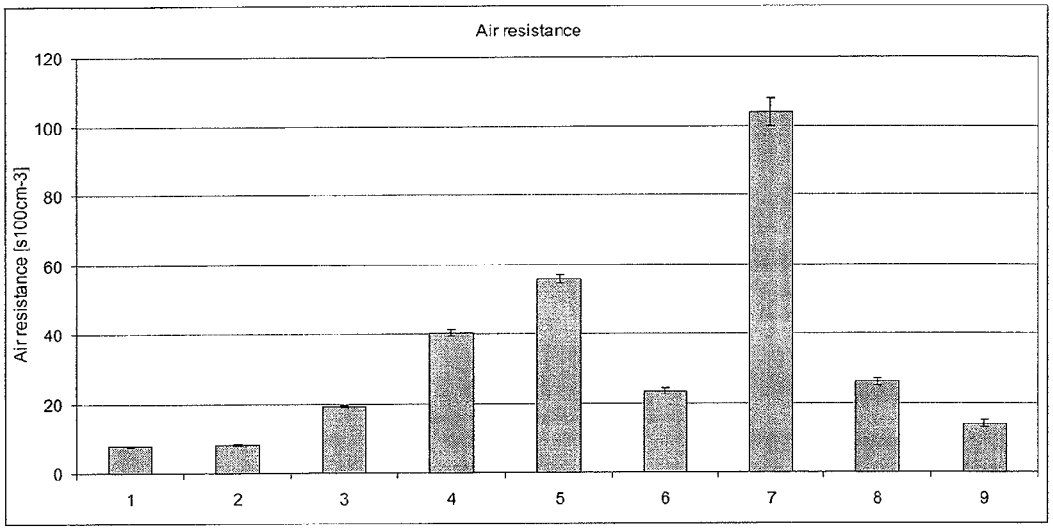
FIG. 10 shows a comparison of handsheets of the prior art and according to the invention containing GCC as a filler with respect to air resistance.
Figure 11:
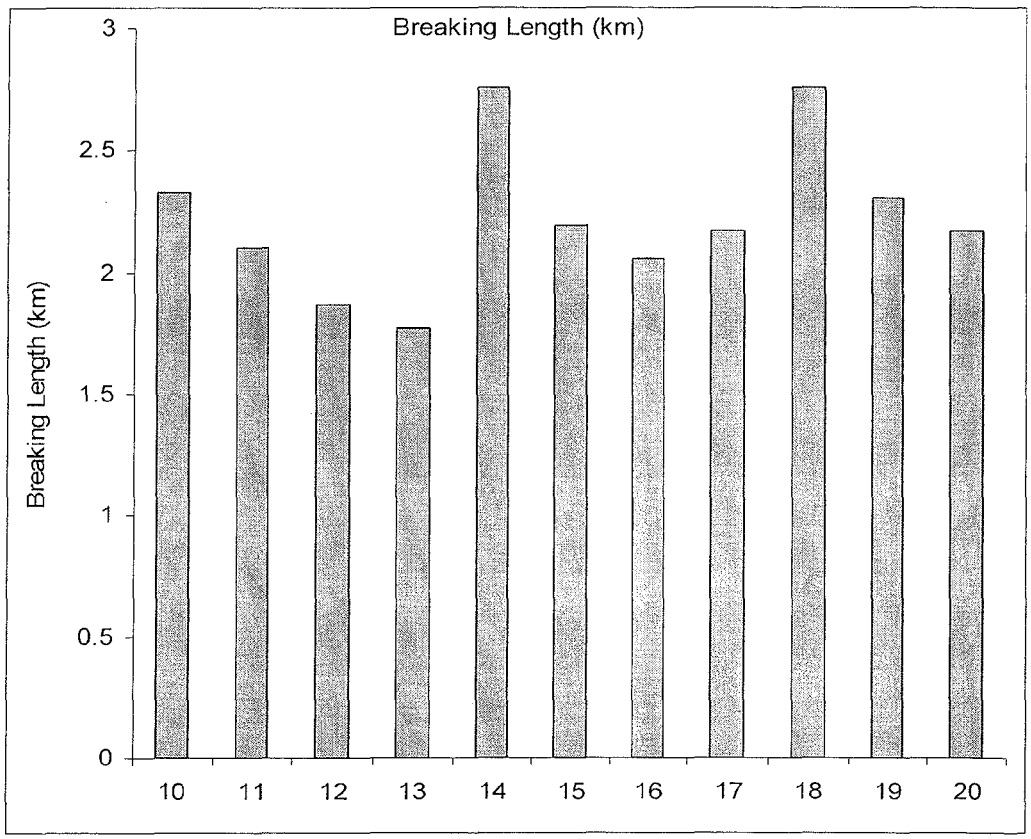
FIG. 11 shows a comparison of handsheets of the prior art and according to the invention containing PCC as a filler with respect to breaking lengths.
Figure 12:
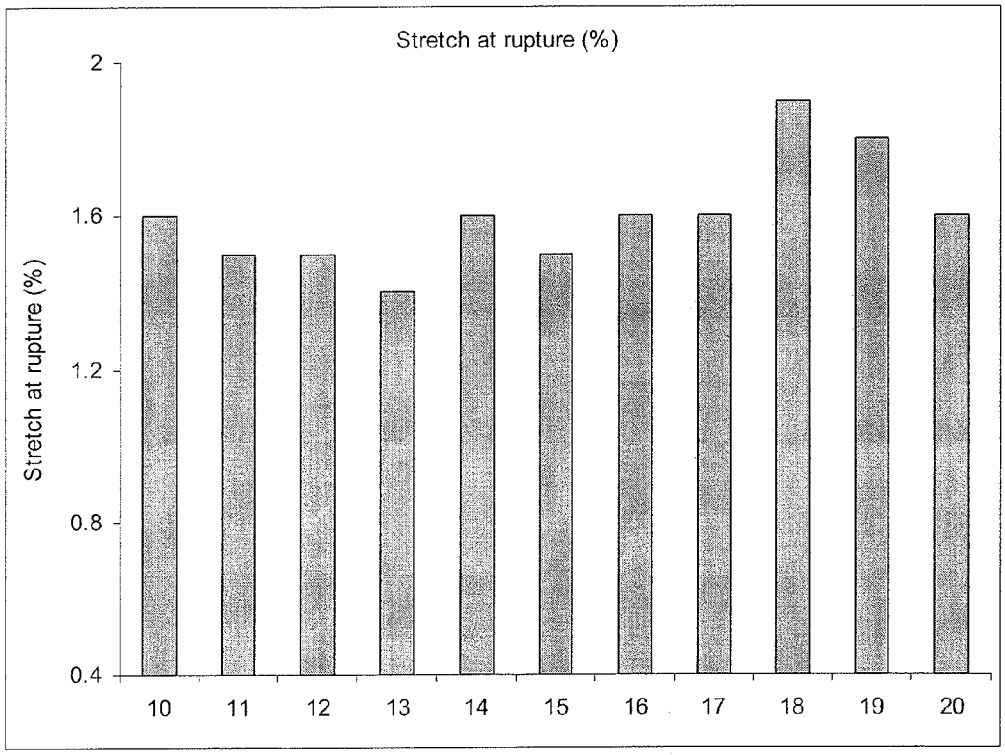
FIG. 12 shows a comparison of handsheets of the prior art and according to the invention containing PCC as a filler with respect to stretch at rupture.
Figure 13:
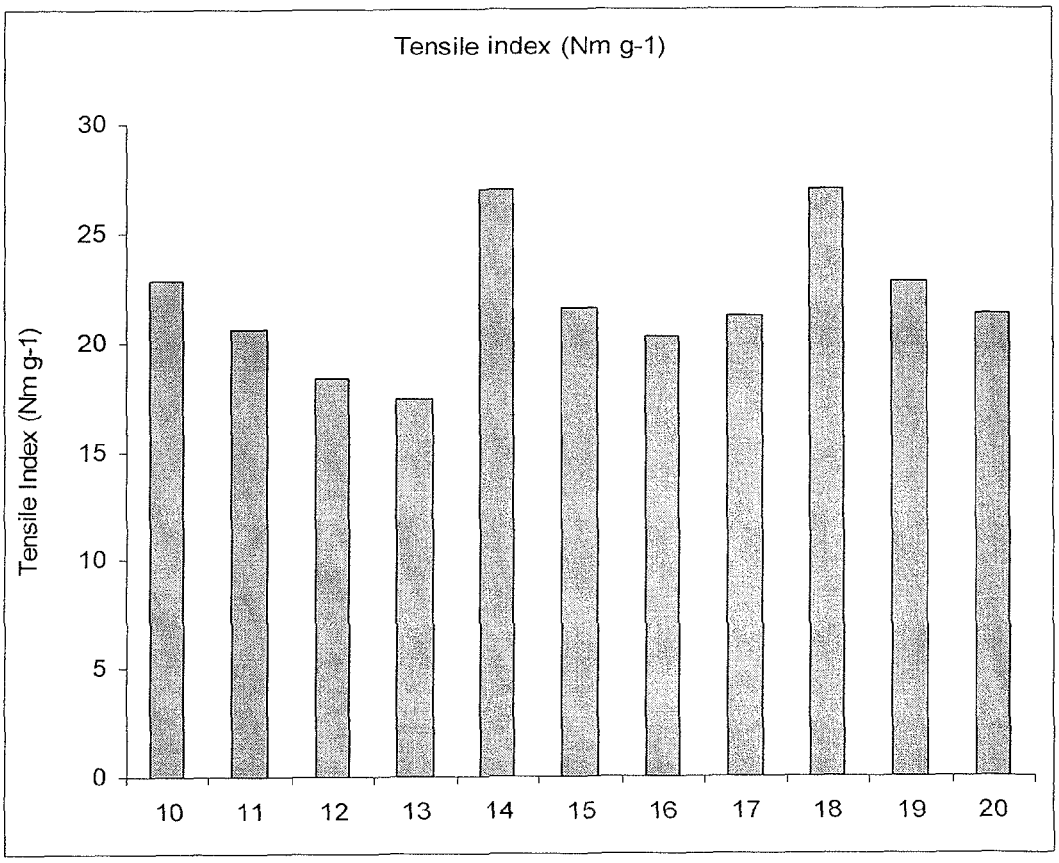
FIG. 13 shows a comparison of handsheets of the prior art and according to the invention containing PCC as a filler with respect to tensile index.
Figure 14:
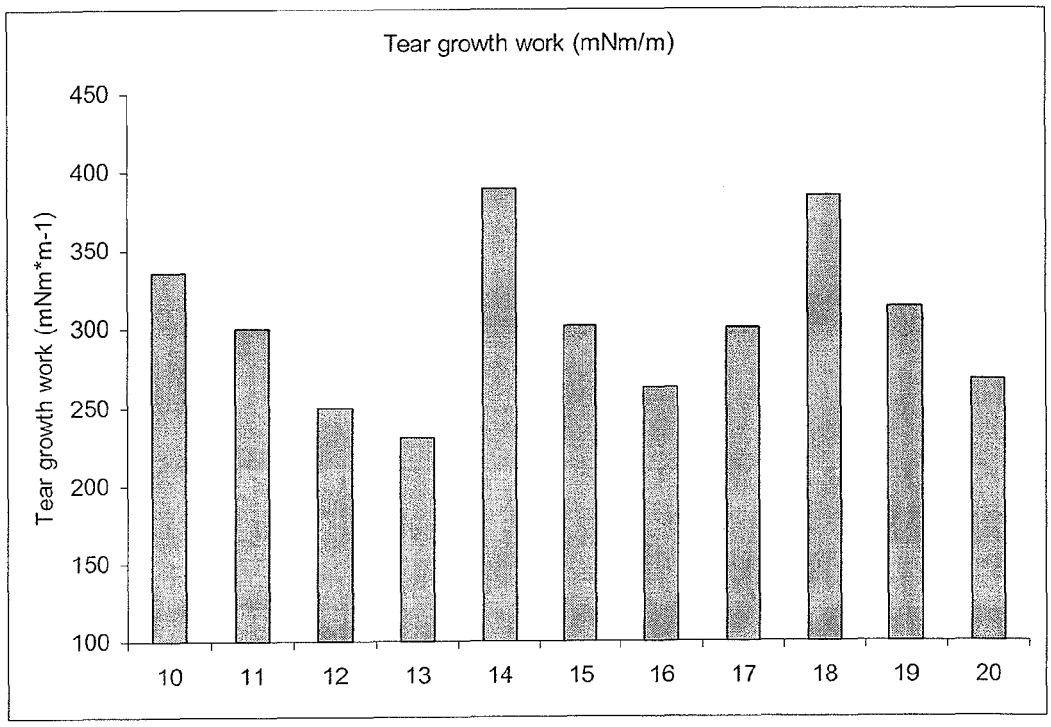
FIG. 14 shows a comparison of handsheets of the prior art and according to the invention containing PCC as a filler with respect to tear growth work.
Figure 15:
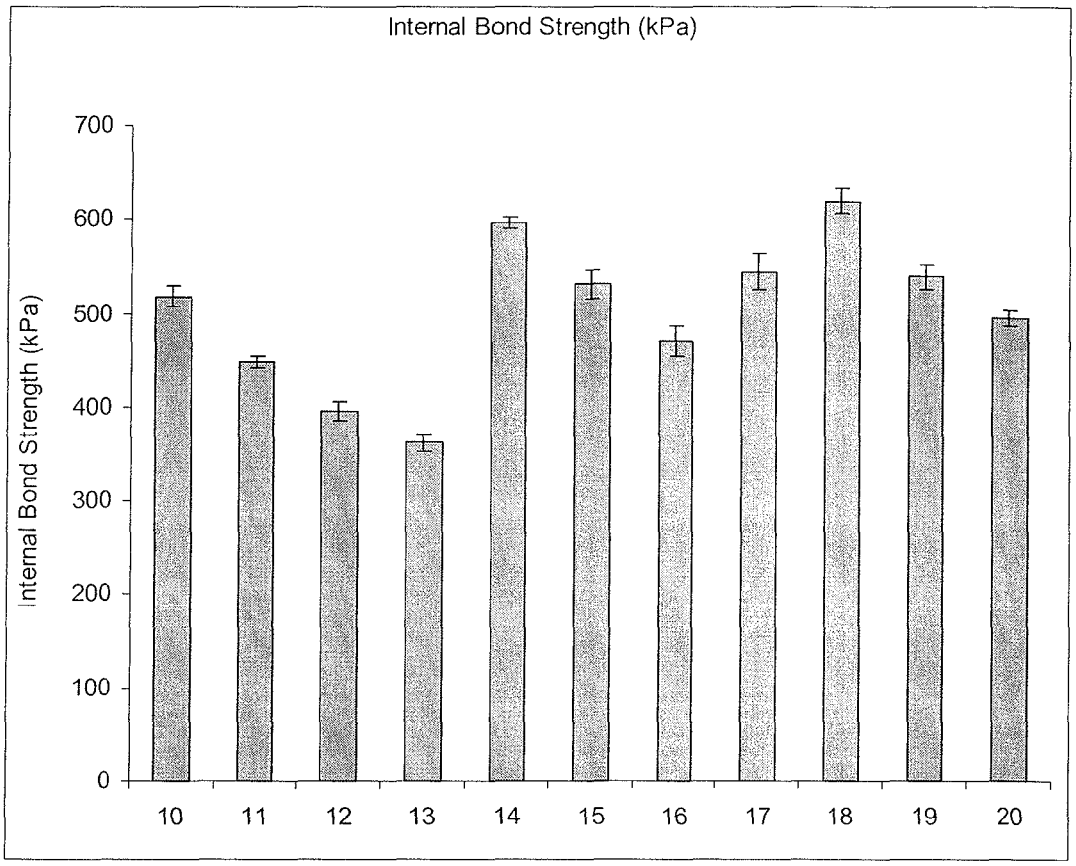
FIG. 15 shows a comparison of handsheets of the prior art and according to the invention containing PCC as a filler with respect to internal bond strength.

As can be taken from FIG. 10, air resistance of comparative hand sheets No. 1 and 2 are about the same or slightly increased with increasing filler content.

Looking at the inventive hand sheets, it can be seen that any one of the hand sheets No. 3, 4, 6, 8 and 9 containing 30 wt % filler, but additional gel, have significantly higher air resistance than comparative hand sheet No. 2.

In this respect, hand sheets No. 5 and 7 containing filler in an amount as high as 50 wt % and gel according to the invention have the highest air resistance.

2. Nano-Fibrillar Cellulosic Gel with Standard PCC Fillers

Material

Filler (Gel):

Hydrocarb® 60 AV (HC 60 AV) (dispersed product) available from Omya AG: Selected, natural ground calcium carbonate (marble), microcrystalline, rhombrohedral particle shape of high fineness in the form of a pre-dispersed slurry. The weight median particle size $d_{50}$ is 1.6 μm, measured by Sedigraph 5100. Suspension solids=78%.

Pulp (Gel):

Dried pine mats, brightness: 88.19%; TCF bleached

Dried Eucalyptus, brightness: 88.77%; TCF bleached

Filler (Hand Sheets):

PCC (Precipitated calcium carbonate) available from Omya AG; scalenohedral particle shape with a $d_{50}$ of 2.4 μm measured by Sedigraph 5100. Specific Surface area: 3.2 $m^2/g$; Suspension solids: 20 wt %; pH: 8.

Pulp (Hand Sheets):

100% Eucalyptus refined to 30° SR (TCF bleaching sequence; Brightness=88.7%)

Retention Aid:

Polyimin 1530 (available from BASF)

Gel Formation

The gels were processed with an ultra-fine friction grinder (Supermasscolloider from Masuko Sangyo Co. Ltd, Japan (Model MKCA 6-2) with mounted silicon carbide stones having a grit class of 46 (grit size 297-420 μm). The dynamic 0-point was adjusted as described in the manual delivered by the supplier (the zero point is defined as the touching point of the stones, so there the gap between the stones is 0 mm) The speed of the rotating grinder was set to 1500 rpm.

The suspensions to be fibrillated were prepared as follows: 80 g of the dry mat pulp was torn into pieces of 40×40 mm and 3920 g tap water were added. The pulp mats were soaked overnight in water. The next day, the suspensions were stirred in a 10 $dm^3$ bucket at 2000 rpm using a dissolver disk with a diameter of 70 mm. The suspensions were stirred for at least 10 minutes at 2000 rpm.

At first, the pulp was disintegrated by passing it two times through the grinder with an open stone gap (0 μm). Subsequently, the stone gap was tightened to −200 μm for fibrillating the pulp in two passages. Filler (according to Table 3) was added to this fibrillated pulp suspension, and this mixture was ground by circulating three times with a stone gap of −300 to −400 μm.

TABLE 3

| Sample | Weight ratio (dry/dry) filler:pulp | Filler | Pulp | Cellulosic solid content [wt %] |
|---|---|---|---|---|
| G | 2:1 | HC-60 AV | *Eucalyptus*, dried | 2 |
| H | 2:1 | HC-60 AV | Pine, dried | 2 |

Hand Sheet Formation 60 g dry of eucalyptus pulp with a SR value of 30° and the according amount of the nanocellulosic gel (see table 4) is diluted in 10 $dm^3$ of tap water. The filler (PCC FS 270 ET) is added in an amount so as to obtain the desired overall filler content based on the final paper weight (see table 4). After 15 minutes of agitation and following addition of 0.06% by dry weight, relative to the dry weight of the paper, of a polyacrylamide retention aid, a sheet with a grammage of 80 $g/m^2$ is formed using Rapid-Kothen type hand sheet former. Each sheet was wet pressed for 1 min. at 0.42 bar and dried using Rapid-Kothen type drier.

The filler content is determined by burning a quarter of a dry hand sheet in a muffle furnace heated to 570° C. After burning is completed, the residue is transferred in a desiccator to cool down. When room temperature is reached, the weight of the residue is measured and the mass is related to the initially measured weight of the dry quarter hand sheet.

TABLE 4

| Hand sheet No. | Basis weight [g/m$^2$] | Pulp [wt %, dry/dry] | Ash (total filler content) [wt %] | Gel type (according to table 3) [wt %, dry/dry] G | H |
|---|---|---|---|---|---|
| 10 (comparative) | 80 | 80.00 | 20 | | |
| 11 (comparative) | 80 | 75.00 | 25 | | |
| 12 (comparative) | 80 | 70.00 | 30 | | |
| 13 (comparative) | 80 | 65.00 | 35 | | |
| 14 (invention) | 80 | 75.38 | 23 | 1.62 | |
| 15 (invention) | 80 | 70.44 | 28 | 1.56 | |
| 16 (invention) | 80 | 65.50 | 33 | 1.50 | |
| 17 (invention) | 80 | 62.03 | 35 | 2.97 | |
| 18 (invention) | 80 | 74.39 | 24 | | 1.61 |
| 19 (invention) | 80 | 68.46 | 30 | | 1.54 |
| 20 (invention) | 80 | 63.52 | 35 | | 1.48 |

Hand Sheet Testing

As in the case of hand sheets combining nano-fibrillar cellulosic gel with standard GCC fillers, comparable effects on mechanical, optical and penetration and printing properties were found when the filler added to the hand sheets was a standard PCC filler.

Thus, mechanical properties as well as printing and penetration properties (expressed by the air permeance of the respective hand sheets) could be significantly improved at comparable optical properties.

The hand sheets were tested and characterized as follows:

1. Mechanical Properties

The mechanical properties of the hand sheets according to the invention were characterized by their breaking length, stretch at rupture, tensile index, tear growth work, and internal bond.

Breaking length, stretch at rupture, and tensile index of the hand sheets were determined by the tensile test according to ISO 1924-2. Tear growth work was determined according to DIN 53115. Internal bond was determined according to SCAN-P80:98/TAPPI T 541 om.

As can be taken from FIGS. 11, 12, 13, 14 and 15, breaking length, stretch at rupture, tensile index, tear growth work, and internal bond values of comparative hand sheets No. 10-13 essentially decrease with increasing filler content.

Looking at the inventive hand sheets, it can be seen that any one of the hand sheets No. 14-20 containing corresponding amounts of filler, but additional gel, have better breaking lengths, stretch at rupture, tensile index, tear growth work, and internal bond properties than the corresponding comparative hand sheets.

2. Optical Properties

The optical properties of the hand sheets according to the invention were characterized by their opacity and light scattering.

Opacity of the hand sheets was determined according to DIN 53146. Light scattering was determined according to DIN 54500.

Figure 16:
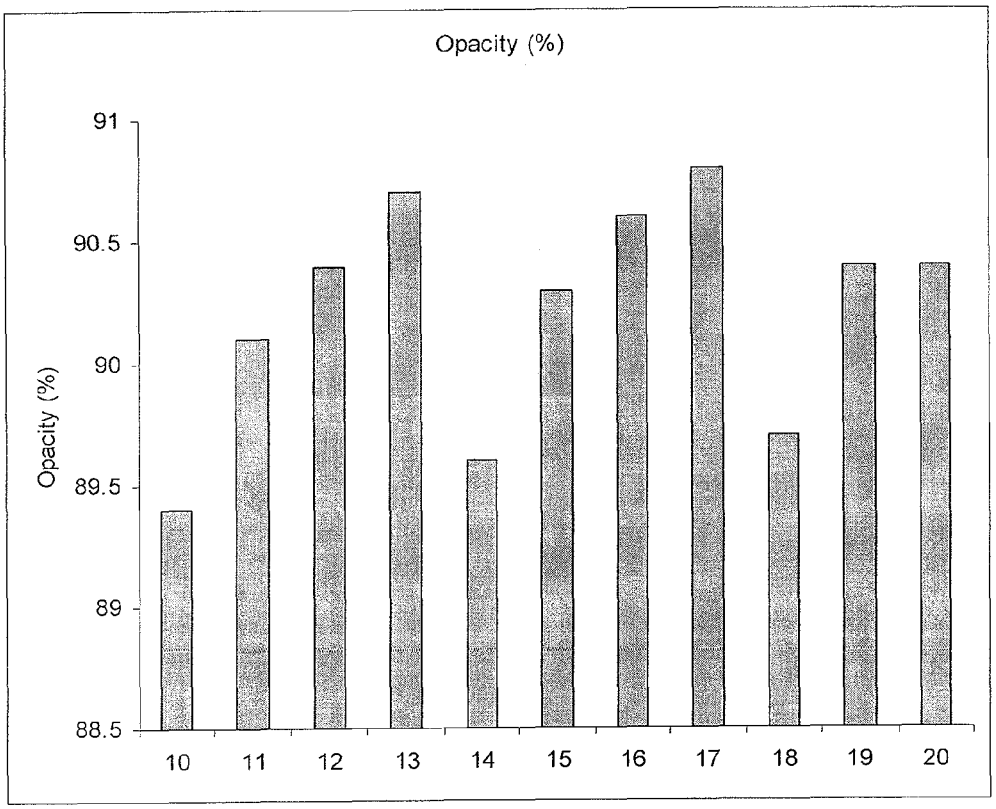
FIG. 16 shows a comparison of handsheets of the prior art and according to the invention containing PCC as a filler with respect to opacity.
Figure 17:
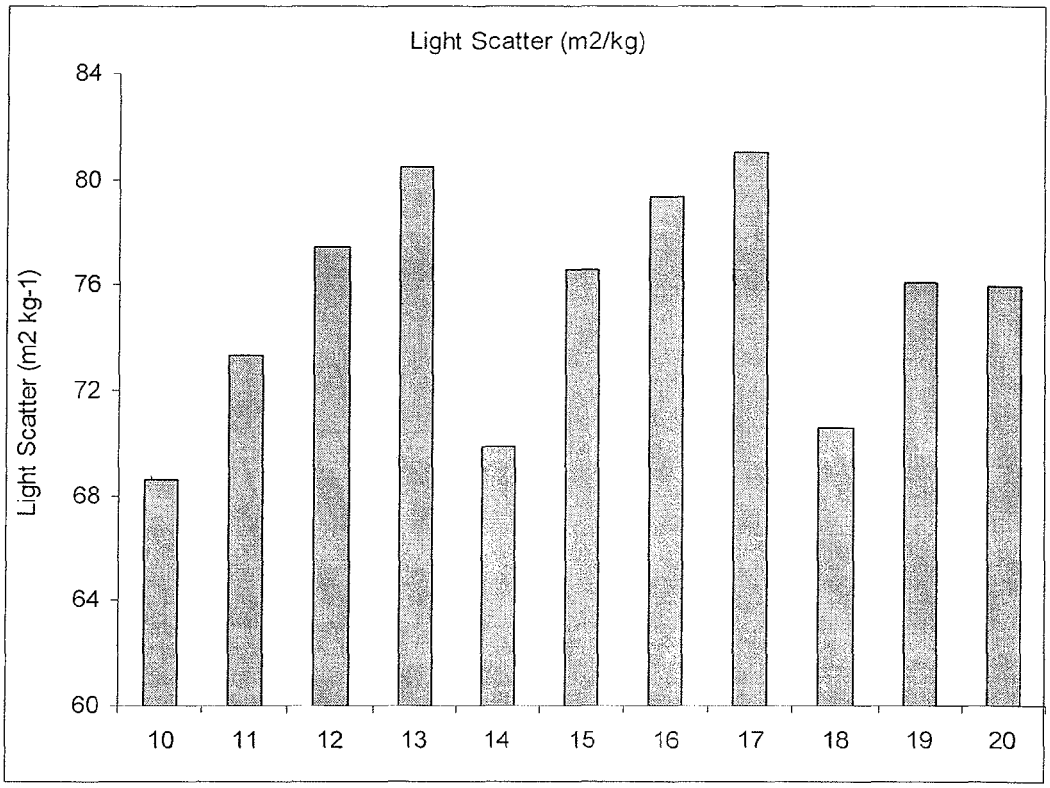
FIG. 17 shows a comparison of handsheets of the prior art and according to the invention containing PCC as a filler with respect to light scattering.

As can be taken from FIGS. 16 and 17, opacity and light scattering of comparative hand sheets No. 10-13 increase with increasing filler content.

Looking at the inventive hand sheets, it can be seen that any one of hand sheets No. 14-20 containing corresponding amounts of filler, but additional gel, have comparable or better opacity and light scattering properties than the corresponding comparative hand sheets.

3. Air Permeance

The air permeance was determined according to ISO 5636-1/-3.

Figure 18:
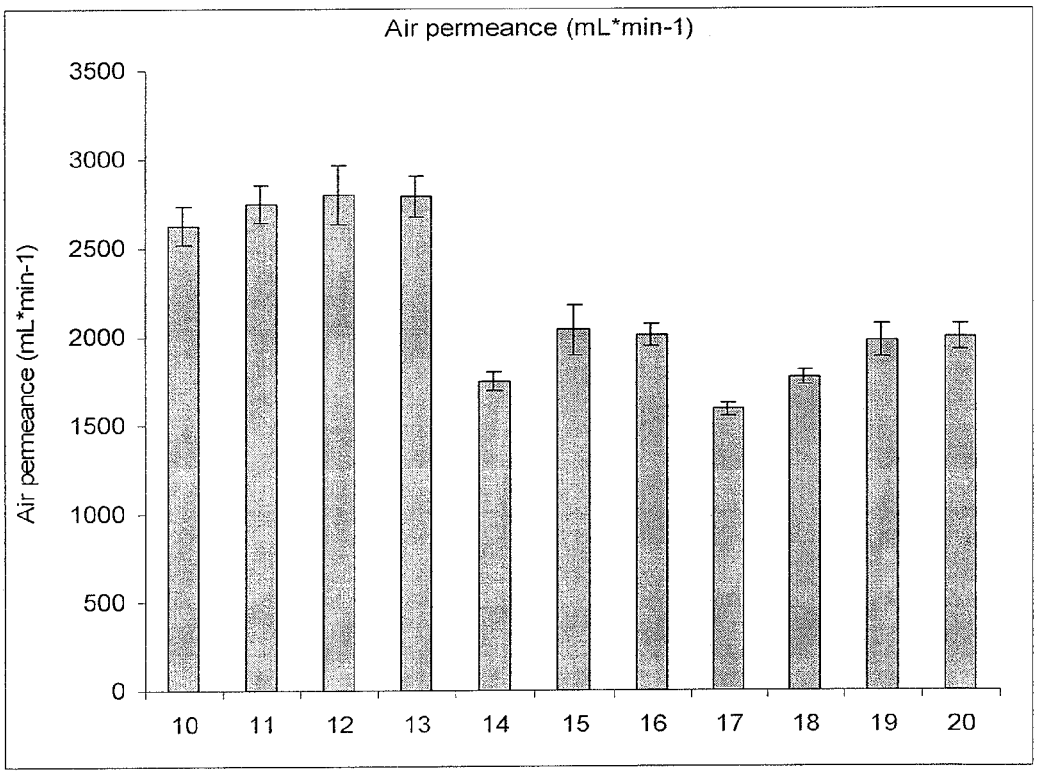
FIG. 18 shows a comparison of handsheets of the prior art and according to the invention containing PCC as a filler with respect to air permeance.
Figure 19:
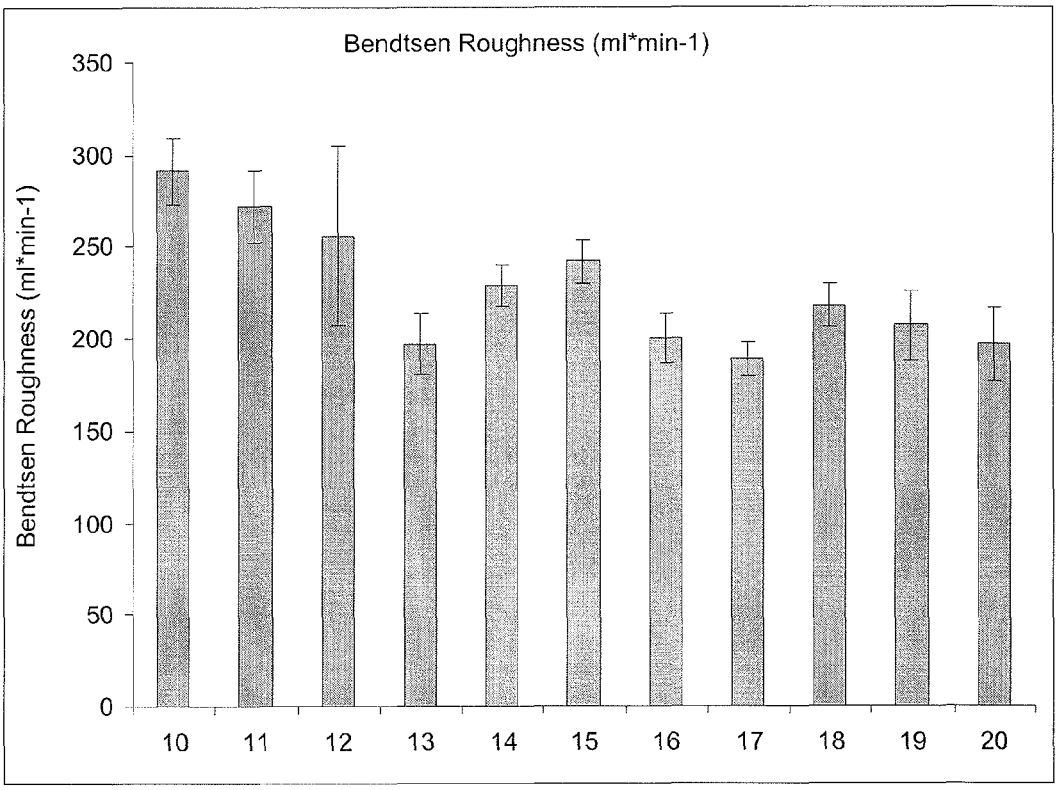
FIG. 19 shows a comparison of handsheets of the prior art and according to the invention containing PCC as a filler with respect to Bendtsen roughness.

As can be seen from FIG. 18, air permeance of comparative hand sheets No. 10-13 is about the same or slightly increased with increasing filler content.

Looking at the inventive hand sheets, it can be seen that any one of hand sheets No. 14-20 containing corresponding amounts of filler, but additional gel, have significantly lower air permeance than the corresponding comparative hand sheets.

4. Bendtsen Roughness

The Bendsten roughness was determined according to ISO 8791-2.

A low surface roughness is of advantage for the calendering properties. A lower surface roughness means that less pressure has to be applied for calendering.

As can be taken from FIG. 18, the Bendtsen roughness of comparative hand sheets No. 10-13 decreases with increasing filler content. However, looking at the inventive hand sheets, it can be seen that any one of hand sheets No. 14-20 containing corresponding amounts of filler, but additional gel, have a comparable or lower Bendtsen roughness than the corresponding comparative hand sheet, and thus provide a low surface roughness.

The invention claimed is:

1. A process for manufacturing a structured material comprising the steps of:

(a) providing cellulose fibres;

(b) providing at least one filler comprising calcium carbonate;

(c) combining the cellulose fibres of step a) and the at least one filler of step b) at a weight ratio of fibres to filler on a dry weight basis of from 1:33 to 10:1;

(d) fibrillating the cellulose fibres in an aqueous environment in the presence of the at least one filler from step c) until a nano-fibrillar gel is formed; wherein the formation of the gel is verified by monitoring the viscosity of the mixture in dependence of the shearing rate, wherein the viscosity decrease of the mixture upon step-wise increase of the shearing rate is larger than the corresponding viscosity increase upon subsequent step-wise reduction of the shearing rate over at least part of the shear rate range as shearing approaches zero;

(e) providing additional non-fibrillated fibres in the form of a fibre web;

(f) combining the nano-fibrillar gel of step d) with the non-fibrillated fibres in the form of a fibre web of step e), so that the combination of the nano-fibrillar gel and the non-fibrillated fibres includes 0.5 to 20 wt. % of the nano-fibrillar gel, expressed by the cellulosic content of the nano-fibrillar gel, on a dry/dry basis; and (g) manufacturing a structured material from the combination of the nano-fibrillar gel and non-fibrillated fibres in the form of a fibre web.

2. The process according to claim 1, wherein the combination of the nano-fibrillar gel and the non-fibrillated fibres in the form of a fibre web from step f) is subjected to dewatering.

3. The process according to claim 1, wherein the cellulose fibres of steps a) and/or e) are independently selected from the group consisting of eucalyptus pulp, spruce pulp, pine pulp, beech pulp, hemp pulp, cotton pulp, bamboo pulp, bagasse, recycled pulp, and deinked pulp, or any mixture thereof.

4. The process according to claim 1, wherein the cellulose fibres of step a) are provided in the form of a suspension.

5. The process according to claim 1, wherein the cellulose fibres of step a) are provided in the form of a suspension at a solids content of from 0.2 to 35 wt %.

6. The process according to claim 1, wherein the cellulose fibres of step a) are provided in the form of a suspension at a solids content of from 1 to 4 wt %.

7. The process according to claim 1, wherein the cellulose fibres of step a) are provided in the form of a suspension at a solids content of from 1.3 to 3 wt %.

8. The process according to claim 1, wherein the filler of step b) is selected from the group consisting of precipitated calcium carbonate (PCC), natural ground calcium carbonate (GCC), surface modified calcium carbonate, an d calcium carbonate in admixture with one or more of dolomite, talc, bentonite, clay, magnesite, satin white, sepiolite, huntite, diatomite, or a silicate.

9. The process according to claim 1, wherein the filler of step b) is selected from the group consisting of precipitated calcium carbonate having vateritic, calcitic or aragonitic crystal structure, ultrafine discrete prismatic, scalenohedral or rhombohedral precipitated calcium carbonate, natural ground calcium carbonate, marble, limestone, and chalk, or any mixture thereof.

10. The process according to claim 1, wherein the filler of step b) consists of particles having a median particle size of from 0.01 to 15 μm.

11. The process according to claim 1, wherein the filler of step b) consists of particles having a median particle size of from 0.5 to 4 μm.

12. The process according to claim 1, wherein before, during or after the addition of further non-fibrillated fibres in the form of a fibre web in step e), but after step d) and before step f), at least one further filler is added.

13. The process according to claim 12, wherein the at least one further filler is selected from the group consisting of precipitated calcium carbonate (PCC), natural ground calcium carbonate (GCC), surface modified calcium carbonate, dolomite, talc, bentonite, clay, magnesite, satin white, sepiolite, huntite, diatomite, and silicate, or any mixture thereof.

14. The process according to claim 12, wherein the at least one further filler is selected from the group consisting of precipitated calcium carbonate having vateritic, calcitic or aragonitic crystal structure, ultrafine discrete prismatic, scalenohedral or rhombohedral precipitated calcium carbonate, natural ground calcium carbonate, marble, limestone, and chalk, or any mixture thereof.

15. The process according to claim 12, wherein the at least one further filler consists of particles having a median particle size of from 0.01 to 5 μm.

16. The process according to claim 12, wherein the at least one further filler consists of particles having a median particle size of from 0.1 to 0.8 μm.

17. The process according to claim 12, wherein the filler of step b) and/or the at least one further filler is associated with a dispersing agent selected from the group consisting of homopolymers or copolymers of polycarboxylic acids and/or their salts or derivatives or esters thereof; esters based on acrylic acid, methacrylic acid, maleic acid, fumaric acid, itaconic acid; acryl amide or acrylic esters, methylmethacrylate, or any mixture thereof; and alkali polyphosphates, phosphonic-, citric- and tartaric acids and the salts or esters thereof; or any mixture thereof.

18. The process according to claim 1, wherein the step c) is carried out by adding the filler to the fibres, or the fibres to the filler in one or several steps.

19. The process according to claim 1, wherein the filler of step b) and/or the fibres of step a) are added entirely or in portions before or during the fibrillating step d).

20. The process according to claim 1, wherein the weight ratio of fibres to filler of step b) on a dry weight basis is from 1:2 to 2:1.

21. The process according to claim 1, wherein the fibrillating is carried out with a homogenizer or a friction grinder.

22. The process according to claim 1, wherein the combination of the nano-fibrillar gel and the non-fibrillated fibres in the form of a fibre web includes 3 to 6 wt % of the nano-fibrillar gel, expressed by the cellulosic content of the gel, on dry/dry weight basis.

23. The process according to claim 1, wherein the total content of filler on a dry weight basis of the structured material is from 1 wt % to 60 wt %.

24. The process according to claim 1, wherein the total content of filler on a dry weight basis of the structured material is from 25 wt % to 40 wt %.

25. The process according to claim 1, wherein the total content of filler on a dry weight basis of the structured material is from 30 wt % to 35 wt %.

26. A process for manufacturing a structured material comprising the steps of:

(a) providing cellulose fibres;

(b) providing at least one filler comprising calcium carbonate and one or more of dolomite, talc, bentonite, clay, magnesite, satin white, sepiolite, huntite, diatomite, and a silicate;

(c) combining the cellulose fibres of step a) and the at least one filler of step b) at a weight ratio of fibres to filler on a dry weight basis of from 1:33 to 10:1;

(d) fibrillating the cellulose fibres in an aqueous environment in the presence of the at least one filler from step c) a nano-fibrillar gel is formed; wherein the formation of the gel is verified by monitoring the viscosity of the mixture in dependence of the shearing rate, wherein the viscosity decrease of the mixture upon step-wise increase of the shearing rate is larger than the corresponding viscosity increase upon subsequent step-wise reduction of the shearing rate over at least part of the shear rate range as shearing approaches zero;

(e) providing additional non-fibrillated fibres in the form of a fibre web;

(f) combining the nano-fibrillar gel of step d) with the fibres of step e), so that the combination of the nano-fibrillar gel and the non-fibrillated fibres includes 0.5 to 20 wt. % of the nano-fibrillar gel, expressed by the cellulosic content of the nano-fibrillar gel, on a dry/dry basis; and (g) manufacturing a structured material from the combination of the gel and fibres.

* * * * *